US009549274B2

(12) United States Patent
Nakamura et al.

(10) Patent No.: US 9,549,274 B2
(45) Date of Patent: Jan. 17, 2017

(54) SOUND PROCESSING APPARATUS, SOUND PROCESSING METHOD, AND SOUND PROCESSING PROGRAM

(71) Applicant: HONDA MOTOR CO., LTD., Tokyo (JP)

(72) Inventors: Keisuke Nakamura, Wako (JP); Kazuhiro Nakadai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 120 days.

(21) Appl. No.: 14/572,941

(22) Filed: Dec. 17, 2014

(65) Prior Publication Data

US 2015/0172842 A1 Jun. 18, 2015

(30) Foreign Application Priority Data

Dec. 18, 2013 (JP) ..... 2013-261544

(51) Int. Cl.
*H04R 29/00* (2006.01)

(52) U.S. Cl.
CPC ..... *H04R 29/004* (2013.01); *H04R 2430/20* (2013.01); *H04R 2499/13* (2013.01)

(58) Field of Classification Search
USPC ..... 381/92
See application file for complete search history.

(56) References Cited

U.S. PATENT DOCUMENTS

2004/0174991 A1* 9/2004 Hirai ..... H04R 3/02 379/406.08
2009/0012794 A1* 1/2009 van Wijngaarden ... G10L 25/48 704/270
2009/0034752 A1 2/2009 Zhang et al.
2009/0052684 A1* 2/2009 Ishibashi ..... H04R 3/005 381/66
2015/0244869 A1* 8/2015 Cartwright ..... H04M 3/568 370/260

FOREIGN PATENT DOCUMENTS

JP 2002-328682 A 11/2002
JP 2007-302155 A 11/2007
JP 2013-030956 A 2/2013
WO WO 2013/101073 A1 7/2013

OTHER PUBLICATIONS

Notice of Reasons for Rejection dated May 24, 2016 corresponding to Japanese Patent Application No. 2013-261544 and English translation thereof.

* cited by examiner

*Primary Examiner* — Quynh Nguyen
(74) *Attorney, Agent, or Firm* — Squire Patton Boggs (US) LLP

(57) ABSTRACT

A sound processing apparatus includes: a first sound collecting unit placed in a sound field and configured to collect a sound signal which is speech of a talker; a second sound collecting unit arranged to be movable to a position which is closer to a talker than the first sound collecting unit and configured to collect the sound signal; a transfer function estimating unit configured to estimate a transfer function from a sound signal collected by the first sound collecting unit and a sound signal collected by the second sound collecting unit when a talker is at a predetermined position in the sound field; and a sound signal processing unit configured to perform a process of the sound signal by use of the transfer function estimated by the transfer function estimating unit.

11 Claims, 27 Drawing Sheets

SOUND PROCESSING APPARATUS, SOUND PROCESSING METHOD, AND SOUND PROCESSING PROGRAM

CROSS-REFERENCE TO RELATED APPLICATION

Priority is claimed on Japanese Patent Application No. 2013-261544, filed on Dec. 18, 2013, the contents of which are incorporated herein by reference.

BACKGROUND

Field of the Invention

The present invention relates to a sound processing apparatus, a sound processing method, and a sound processing program.

Background

A sound system has been proposed which adjusts sound quality and sound volume of a sound signal to be broadcasted to a room inside. In such a sound system, a plurality of predetermined band noise signals are output from a loudspeaker provided inside a room, and a noise signal detected by a microphone provided in a sound field of the loudspeaker is analyzed, to thereby measure a transfer function (for example, refer to Japanese Patent Application, Publication No. 2002-328682A).

In this way, a sound signal emitted from a loudspeaker is collected by a microphone, and a transfer function is obtained from the collected sound signal. The obtained transfer function is used for noise suppression, or estimation of the direction and the position of a sound source.

SUMMARY

However, according to the technique described above, when a process on a speech signal uttered by a talker (a speaker, a person) is performed, if a measuring point by a loudspeaker and an uttering position of a talker are slightly mismatched, the accuracy of the process is degraded. Further, according to the technique described above, it is difficult to match a sound volume of an actual talker and a sound volume of a preliminary measurement for measuring a transfer function. As a result, according to the technique described above, there is a problem that since reverberation characteristics and the like change due to the difference of the sound volumes, the accuracy of the process is insufficient.

An object of an aspect of the present invention is to provide a sound processing apparatus, a sound processing method, and a sound processing program capable of accurately estimating a transfer function in a sound field.

(1) A sound processing apparatus according to an aspect of the present invention includes: a first sound collecting unit placed in a sound field and configured to collect a sound signal which is speech of a talker; a second sound collecting unit arranged to be movable to a position which is closer to a talker than the first sound collecting unit and configured to collect the sound signal; a transfer function estimating unit configured to estimate a transfer function from a sound signal collected by the first sound collecting unit and a sound signal collected by the second sound collecting unit when a talker is at a predetermined position in the sound field; and a sound signal processing unit configured to perform a process of the sound signal by use of the transfer function estimated by the transfer function estimating unit.

(2) A sound processing apparatus according to an aspect of the present invention includes: a first sound collecting unit placed in a sound field and configured to collect a sound signal which is speech of a talker; a talker position estimating unit configured to estimate a talker position which is a position of a talker relative to the first sound collecting unit; a transfer function estimating unit configured to estimate a transfer function from the estimated talker position and a sound signal collected by the first sound collecting unit when a talker is at a predetermined position in the sound field; and a sound signal processing unit configured to perform a process of the sound signal by use of the transfer function estimated by the transfer function estimating unit.

(3) A sound processing apparatus according to an aspect of the present invention includes: a first sound collecting unit placed in a sound field and configured to collect a sound signal which is speech of a talker, by use of a plurality of microphones; a delaying unit configured to delay all sound signals collected by the first sound collecting unit, by a predetermined time; a selecting unit configured to select one microphone of the plurality of microphones; a transfer function estimating unit configured to estimate a transfer function of another microphone relative to the selected one microphone by use of a sound signal delayed by the delaying unit; and a sound signal processing unit configured to perform a process of the sound signal by use of the transfer function estimated by the transfer function estimating unit.

(4) In any one of the aspects of the above (1) to (3), the second sound collecting unit may be arranged at a position where a direct sound of a talker can be collected.

(5) In any one of the aspects of the above (1) to (4), the sound processing apparatus may further include: a storage unit configured to store the transfer function estimated by the transfer function estimating unit; and a talker identifying unit configured to identify a talker, wherein the transfer function estimating unit may select, when the transfer function of the talker identified by the talker identifying unit is stored in the storage unit, the transfer function which corresponds to the talker and is stored in the storage unit.

(6) In the aspect of the above (5), the transfer function estimating unit may perform notification which prompts a talker to utter when the transfer function of the talker identified by the talker identifying unit is not stored in the storage unit.

(7) In any one of the aspects of the above (1) to (6), the first sound collecting unit may collect a sound signal when a talker utters, and the transfer function estimating unit may sequentially update the transfer function based on the sound signal collected by the first sound collecting unit.

(8) In the aspect of the above (1), the sound processing apparatus may further include: a storage unit configured to preliminarily store a predetermined transfer function, wherein the transfer function estimating unit may interpolate the transfer function stored preliminarily in the storage unit by use of the transfer function estimated based on the sound signal collected by the first sound collecting unit and the sound signal collected by the second sound collecting unit.

(9) Another aspect of the present invention is a sound processing method including: (a) by way of a first sound collecting unit placed in a sound field, collecting a sound signal which is speech of a talker; (b) by way of a second sound collecting unit arranged to be movable to a position which is closer to a talker than the first sound collecting unit, collecting the sound signal; (c) by way of a transfer function estimating unit, estimating a transfer function from a sound signal collected in the step (a) and a sound signal collected in the step (b) when a talker is at a predetermined position in the sound field; and (d) by way of a sound signal processing unit, performing a process of the sound signal by use of the transfer function estimated in the step (c).

(10) Still another aspect of the present invention is a sound processing method including: (a) by way of a first sound collecting unit placed in a sound field, collecting a sound signal which is speech of a talker, by use of a plurality of microphones; (b) by way of a delaying unit, delaying all sound signals collected in the step (a), by a predetermined time; (c) by way of a selecting unit, selecting one microphone of the plurality of microphones; (d) by way of a transfer function estimating unit, estimating a transfer function of another microphone relative to the one microphone selected in the step (c) by use of a sound signal delayed in the step (b); and (e) by way of a sound signal processing unit, performing a process of the sound signal by use of the transfer function estimated in the step (d).

(11) Still another aspect of the present invention is a non-transitory computer-readable recording medium including a sound processing program causing a computer of a sound processing apparatus including a first sound collecting unit placed in a sound field and a second sound collecting unit arranged to be movable to a position which is closer to a talker than the first sound collecting unit to perform: (a) by way of the first sound collecting unit, collecting a sound signal which is speech of a talker; (b) by way of the second sound collecting unit, collecting the sound signal; (c) estimating a transfer function from a sound signal collected in the step (a) and a sound signal collected in the step (b) when a talker is at a predetermined position in the sound field; and (d) performing a process of the sound signal by use of the transfer function estimated in the step (c).

(12) Still another aspect of the present invention is a non-transitory computer-readable recording medium including a sound processing program causing a computer of a sound processing apparatus including a first sound collecting unit placed in a sound field to perform: (a) by way of the first sound collecting unit, collecting a sound signal which is speech of a talker, by use of a plurality of microphones; (b) delaying all sound signals collected in the step (a), by a predetermined time; (c) selecting one microphone of the plurality of microphones; (d) estimating a transfer function of another microphone relative to the one microphone selected in the step (c) by use of a sound signal delayed in the step (b); and (e) performing a process of the sound signal by use of the transfer function estimated in the step (d).

According to the aspect of the above (1), (9), or (11), it is possible to accurately estimate a transfer function in a sound field.

According to the aspect of the above (2), since the second sound collecting unit is unnecessary, the size of the apparatus can be reduced, and it is possible to estimate a transfer function when a talker utters.

According to the aspect of the above (3), (10), or (12), only by the first sound collecting unit, it is possible to accurately estimate a transfer function based on the delayed sound signals and a selected representative signal.

According to the aspect of the above (4), since the second sound collecting unit can collect the sound signal uttered by a talker in a state where there is no reflected sound, it is possible to accurately estimate a transfer function.

According to the aspect of the above (5), since a transfer function which is already stored in the storage unit can be used, it is possible to save time to estimate a transfer function.

According to the aspect of the above (6), since the sound signal uttered by a talker can be collected when a transfer function is not stored in the storage unit, it is possible to accurately estimate a transfer function.

According to the aspect of the above (7) or (8), since the estimated transfer function can be sequentially updated or interpolated, it is possible to accurately estimate a transfer function.

DESCRIPTION OF THE EMBODIMENTS

First, a problem is described when, in a narrow space such as a vehicle inside, assuming a loudspeaker to be a talker (a speaker, a person), a sound signal emitted from the loudspeaker is collected by a microphone to estimate a transfer function.

For example, since the diameter of the loudspeaker is greater than the size of the mouth of a talker, the reflection time of a reflected sound is different between sound signals emitted from a vibration plate of the loudspeaker depending on the positions from the center to the periphery of the vibration plate. Further, depending on the sound volume from the loudspeaker, multiple times reflection may occur. An example of multiple times reflection is twice reflection. For example, in twice reflection, a sound signal emitted from the loudspeaker is reflected by a seat of the vehicle and then further reflected by a steering wheel of the vehicle. In such a case, since the sound signal after reflection is different from an assumed speech signal uttered by a talker, it is impossible to estimate a transfer function having good accuracy by using the sound signal after reflection. Further, it is difficult to arrange a loudspeaker, inside a vehicle, at the same position as a position of the mouth of a talker.

Since there is such a problem, when a loudspeaker and a microphone are arranged inside a vehicle, a sound signal emitted from the loudspeaker is collected by the microphone, and a transfer function is estimated from the collected sound signal, there is a problem that only a recognition rate of about 30% can be obtained in speech recognition using the transfer function.

Next, an outline of an embodiment of the present invention is described.

In a sound processing apparatus according to an embodiment of the present invention, a transfer function of a sound field is estimated using speech by an actual talker.

Thereby, the difference of reflection caused by the diameter of the loudspeaker described above is resolved, the number of reflection in a room inside is also matched with that of an actual talker, and further it is possible to solve the problem relating to the position of the mouth of a talker.

First Embodiment

Hereinafter, an embodiment of the present invention will be described with reference to the drawings.

Figure 1:
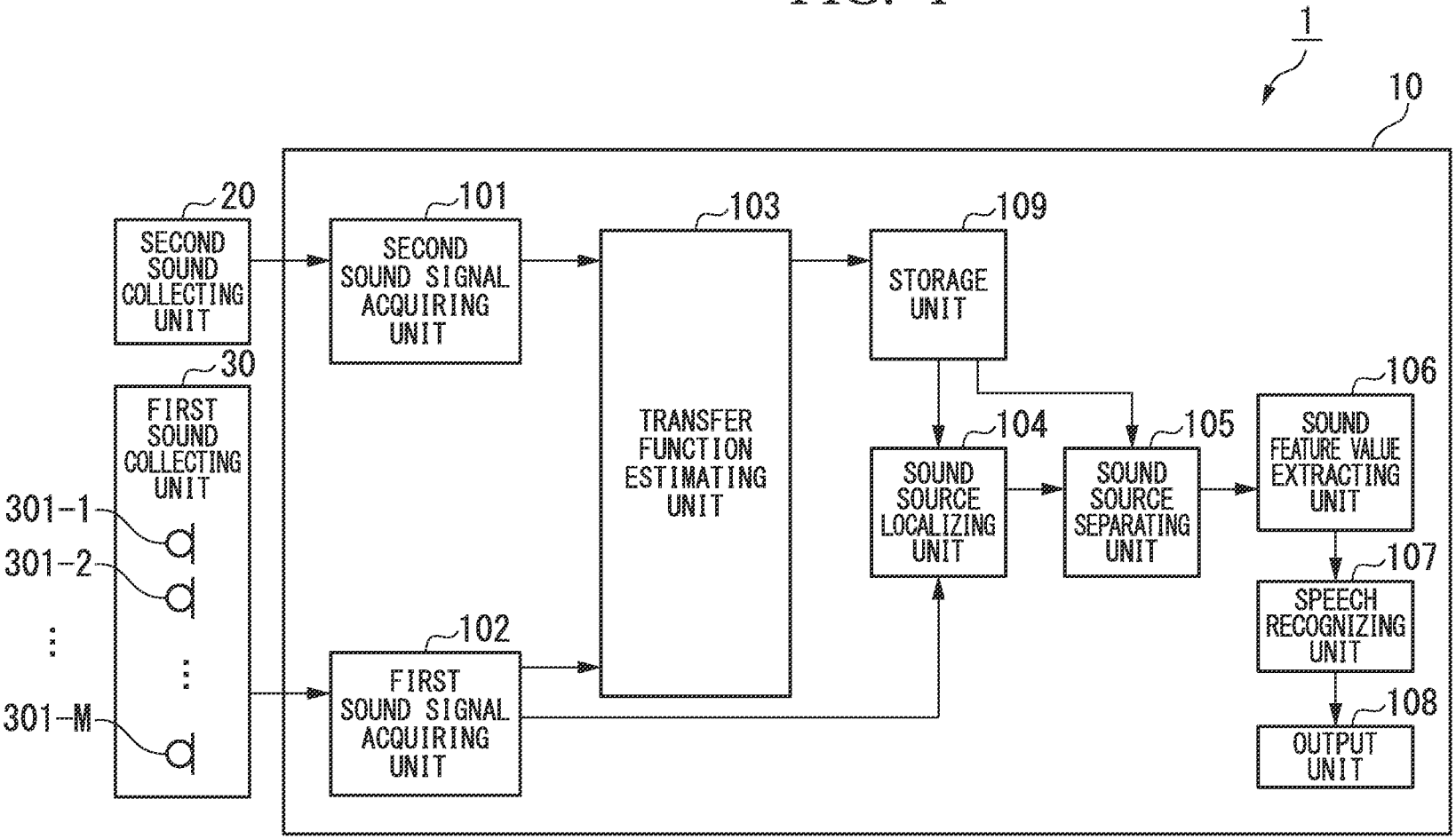
FIG. 1 is a block diagram showing a configuration of a sound processing apparatus according to a first embodiment.

FIG. 1 is a block diagram showing a configuration of a sound processing apparatus 10 according to the present embodiment. As shown in FIG. 1, a sound processing system 1 includes the sound processing apparatus 10, a second sound collecting unit 20, and a first sound collecting unit 30. Further, the sound processing apparatus 10 includes a second sound signal acquiring unit 101, a first sound signal acquiring unit 102, a transfer function estimating unit 103, a sound source localizing unit 104, a sound source separating unit 105, a sound feature value extracting unit 106, a speech recognizing unit 107, an output unit 108 and a storage unit 109. Further, the second sound collecting unit 20 and the first sound collecting unit 30 are connected to the sound processing apparatus 10.

The second sound collecting unit 20 collects a sound signal of one channel and transmits the collected sound signal of one channel to the sound processing apparatus 10. The second sound collecting unit 20 is a close-talking microphone worn by a talker. The second sound collecting unit 20 includes, for example, one microphone which receives a sound wave having a component of a frequency band (for example, 200 Hz to 4 kHz). The second sound collecting unit 20 may transmit the collected sound signal of one channel in a wireless manner or a wired manner.

The second sound collecting unit 20 may be, for example, a mobile phone having a microphone. In this case, the mobile phone may transmit an acquired sound signal to the second sound signal acquiring unit 101, for example, in a wireless manner.

The first sound collecting unit 30 collects sound signals of M (M is an integer greater than 1, for example, 8) channels and transmits the collected sound signals of M channels to the sound processing apparatus 10. The first sound collecting unit 30 includes, for example, M microphones 301-1 to 301-M which receive a sound wave having a component of a frequency band (for example, 200 Hz to 4 kHz). Hereinafter, the microphones 301-1 to 301-M are referred to simply as the microphone 301 unless otherwise stated. The first sound collecting unit 30 may transmit the collected sound signals of M channels in a wireless manner or a wired manner. When M is greater than 1, the sound signals only have to be synchronized with each other between the channels at the time of transmission.

The second sound signal acquiring unit 101 acquires the one sound signal collected by the one microphone of the second sound collecting unit 20. The second sound signal acquiring unit 101 outputs the acquired one sound signal to the transfer function estimating unit 103. Alternatively, the second sound signal acquiring unit 101 applies Fourier transform on the acquired one sound signal for each frame in a time domain and thereby generates an input signal in a frequency domain. The second sound signal acquiring unit 101 outputs the one sound signal applied with Fourier transform to the transfer function estimating unit 103.

The first sound signal acquiring unit 102 acquires the M sound signals collected by the M microphones 301 of the first sound collecting unit 30. The first sound signal acquiring unit 102 outputs the acquired M sound signals to the transfer function estimating unit 103. Alternatively, the first sound signal acquiring unit 102 applies Fourier transform on the acquired M sound signals for each frame in a time domain and thereby generates input signals in a frequency domain. The first sound signal acquiring unit 102 outputs the M sound signals applied with Fourier transform to the transfer function estimating unit 103.

The transfer function estimating unit 103 estimates a transfer function as described below by using the sound signal input from the second sound signal acquiring unit 101 and the first sound signal acquiring unit 102 and causes the storage unit 109 to store the estimated transfer function. The transfer function estimating unit 103 may associate a talker and a transfer function and may cause the storage unit 109 to store the transfer function associated with the talker, for example, in such a case that there are a plurality of drivers who use a vehicle. In this case, for example, in response to information input by a driver via an operation unit (not shown), the transfer function estimating unit 103 reads out and uses a transfer function corresponding to the driver, of the transfer functions stored in the storage unit 109.

A transfer function is stored in the storage unit 109. In such a case that there are a plurality of drivers who use a vehicle, a talker and a transfer function are associated and stored in the storage unit 109.

The sound source localizing unit 104 reads out a transfer function stored in the storage unit 109 corresponding to a sound signal input from the first sound signal acquiring unit 102 and estimates a sound source direction by using the transfer function which is read out (hereinafter, referred to as sound source localization). The sound source localizing unit 104 outputs information indicating a result of performing sound source localization to the sound source separating unit 105.

The sound source separating unit 105 reads out a transfer function stored in the storage unit 109 corresponding the information indicating a result of performing sound source localization input from the sound source localizing unit 104 and performs sound source separation of a target sound and noise by using the transfer function which is read out. The sound source separating unit 105 outputs a signal corresponding to each sound source obtained by the sound source separation to the sound feature value extracting unit 106. The target sound includes, for example, speech uttered by a talker. Noise includes a sound other than the target sound, such as wind noise or a sound emitted from another apparatus disposed in a room where sound collection is performed.

The sound feature value extracting unit 106 extracts a sound feature value of the signal corresponding to each sound source input from the sound source separating unit 105 and outputs information indicating each extracted sound feature value to the speech recognizing unit 107.

When speech uttered by a person is included in a sound source, the speech recognizing unit 107 performs speech recognition based on the sound feature value input from the sound feature value extracting unit 106 and outputs a recognition result of the speech recognition to the output unit 108.

The output unit 108 is, for example, a display device, a sound signal output device, or the like. The output unit 108 displays information based on the recognition result input from the speech recognizing unit 107 on, for example, a display unit.

Figure 2:
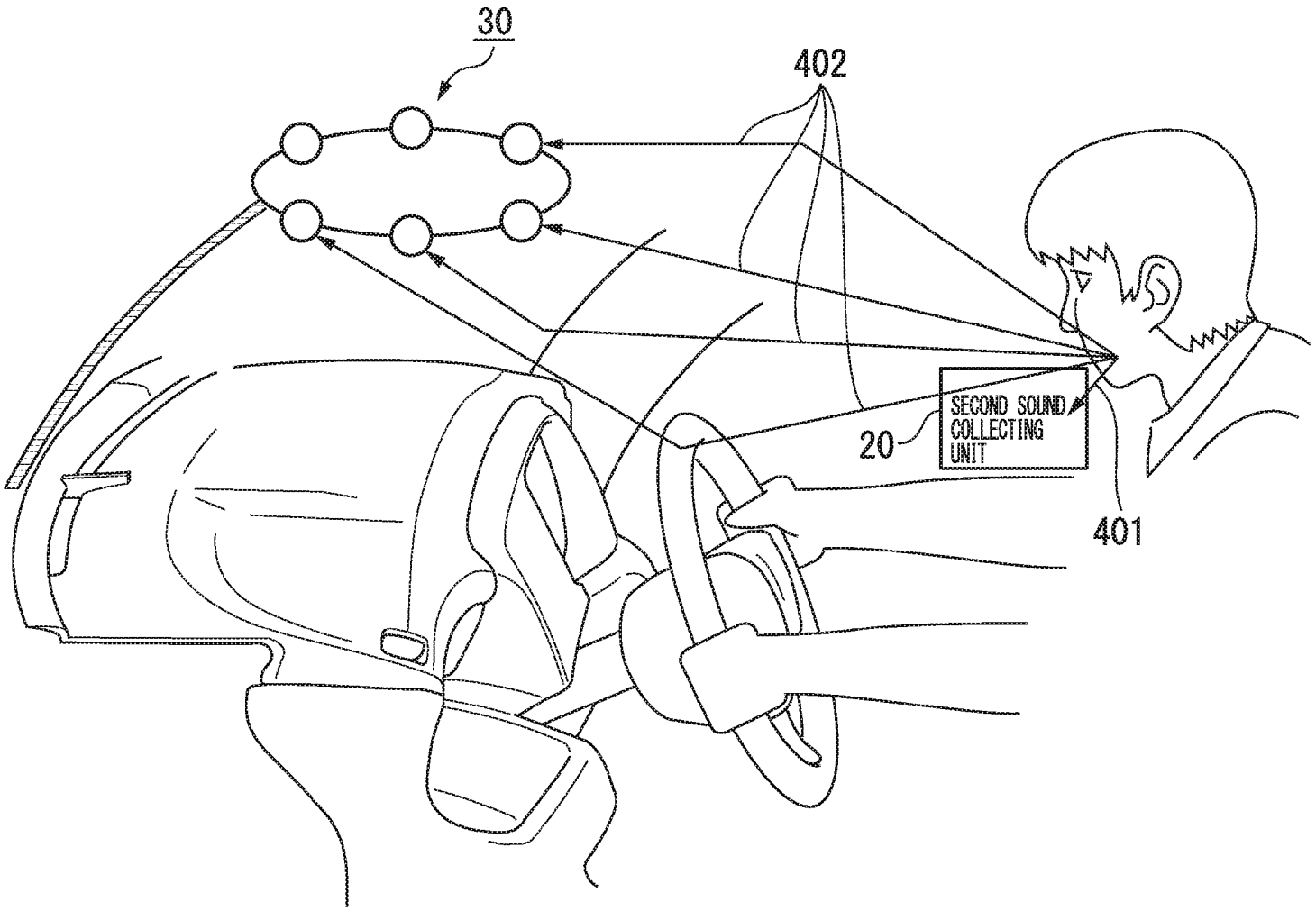
FIG. 2 is a diagram showing an example in which the sound processing apparatus of the present embodiment is applied to a vehicle inside.

FIG. 2 is a diagram showing an example in which the sound processing apparatus 10 of the present embodiment is applied to a vehicle inside. As shown in FIG. 2, the second sound collecting unit 20 is, for example, a close-talking microphone worn by a user and therefore is near the mouth of the user. The first sound collecting unit 30 is attached, for example, near the rearview mirror of the vehicle.

As shown by an image of an arrow 401, a sound signal uttered by a talker is propagated directly to the second sound collecting unit 20. On the other hand, as shown by an image of an arrow 402, a sound signal uttered by a talker is propagated directly to or is propagated, after being reflected by a seat, a steering wheel, and the like of the vehicle, to the first sound collecting unit 30.

The relation between a transfer function and a sound signal collected by the second sound collecting unit 20 and the first sound collecting unit 30 is described.

Figure 3:
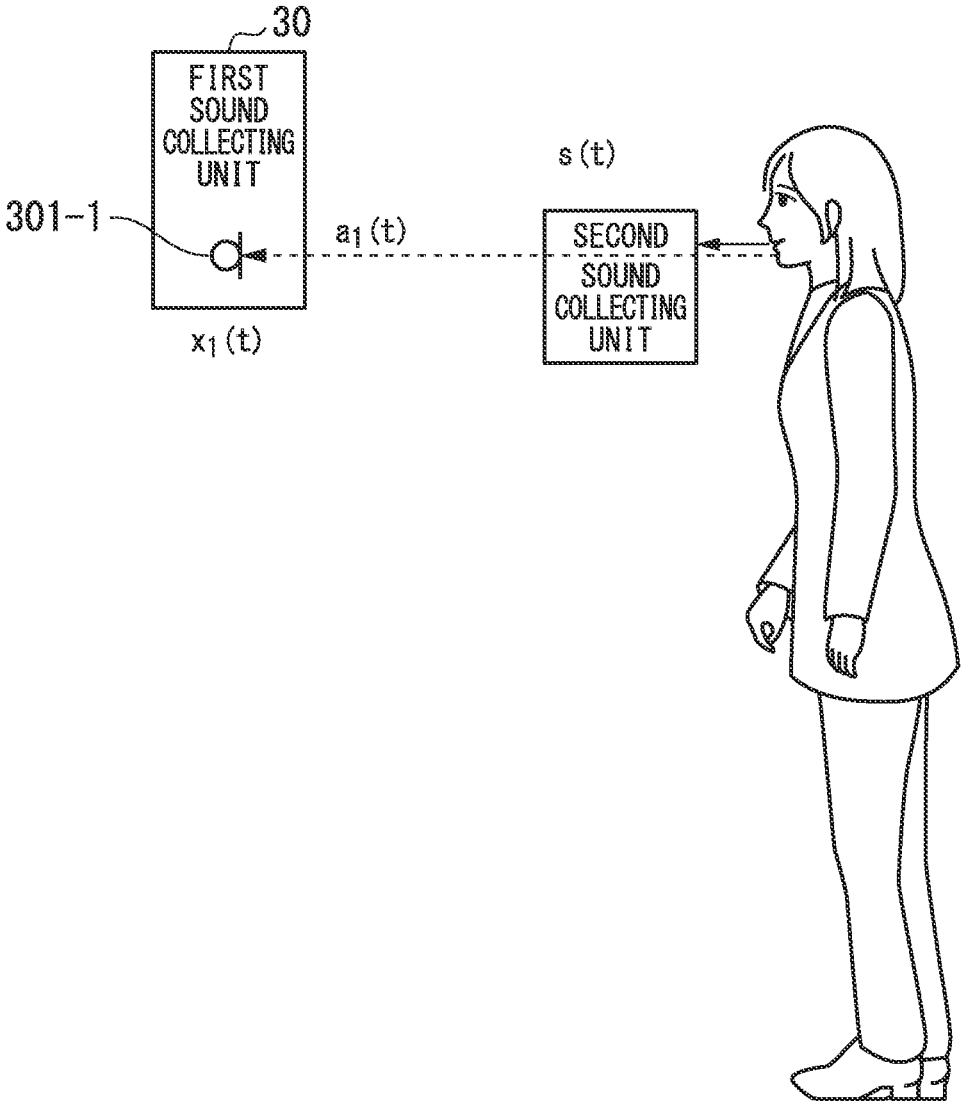
FIG. 3 is a diagram showing an acoustic model when the number of the microphone of a first sound collecting unit is one according to the first embodiment.

FIG. 3 is a diagram showing an acoustic model when the number of the microphone 301 of the first sound collecting unit 30 is one according to the present embodiment.

In FIG. 3, a signal s(t) is a signal in a time domain of a sound signal collected by the second sound collecting unit 20, and a signal $x_1(t)$ is a signal in a time domain of a sound signal collected by the first sound collecting unit 30. An $a_1(t)$ is a transfer function. Thus, the signal $x_1(t)$ in a time domain is expressed by Expression (1).

$$x_1(t)=a_1(t)\otimes s(t) \tag{1}$$

In Expression (1), an operator indicated by X in a circle is an operator of tensor product. Further, when the order is N, Expression (1) is expressed by Expression (2).

$$x_{[N]} = [a_{1[N]}, \ldots , a_{1[1]}]\begin{bmatrix} s_{[1]} \\ \vdots \\ s_{[N]} \end{bmatrix} \tag{2}$$

Further, Expression (1) is expressed by Expression (3) in a frequency domain.

$$X_1(\omega)=A_1(\omega)S(\omega) \tag{3}$$

Next, an acoustic model when the number of the microphone 301 of the first sound collecting unit 30 is M is described.

Figure 4:
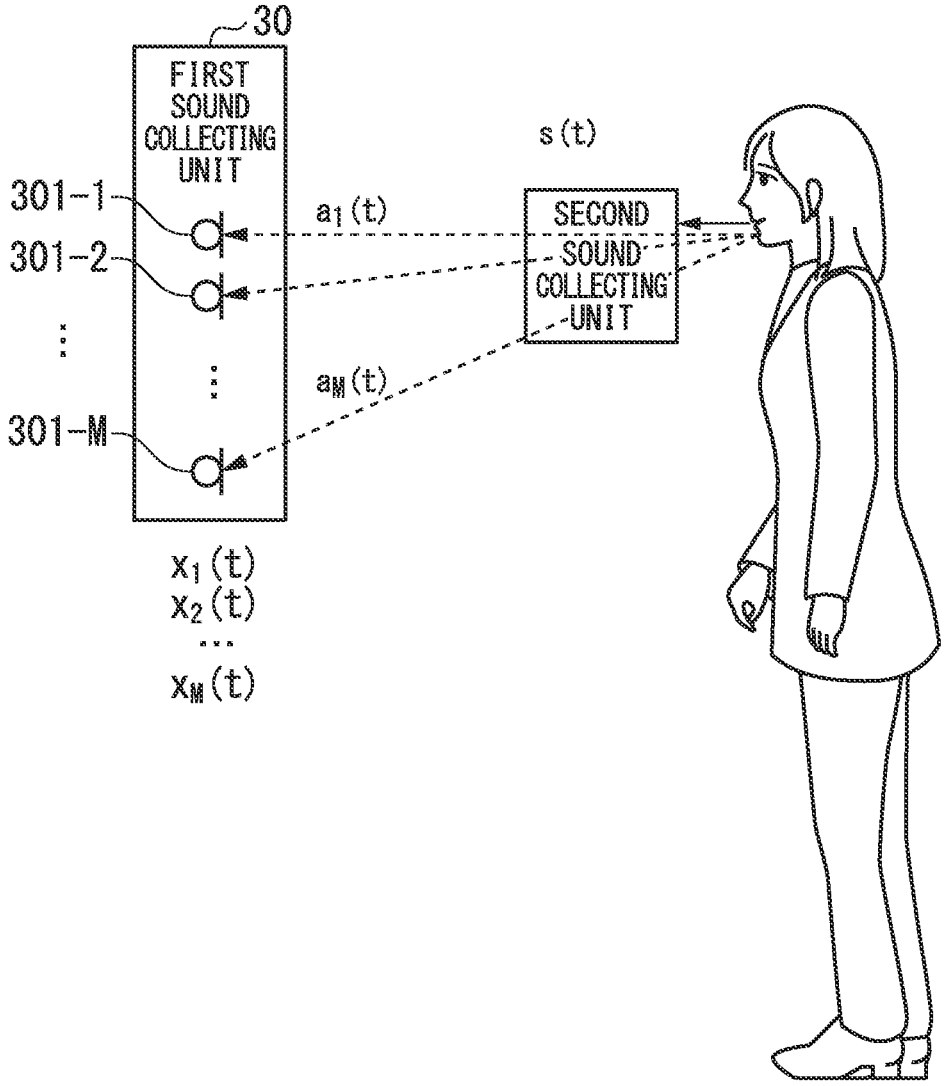
FIG. 4 is a diagram showing an acoustic model when the number of the microphone of the first sound collecting unit is M according to the first embodiment.

FIG. 4 is a diagram showing an acoustic model when the number of the microphone 301 of the first sound collecting unit 30 is M according to the present embodiment.

In FIG. 4, a signal s(t) is a signal in a time domain collected by the second sound collecting unit 20, similar to FIG. 3, and one of signals $x_1(t)$ to $x_M(t)$ is a signal in a time domain collected by each of the microphones 301-1 to 301-M of the first sound collecting unit 30. The $a_1(t)$ to $a_M(t)$ are transfer functions. The signals $x_1(t)$ to $x_M(t)$ in a time domain are expressed by Expression (4).

$$\begin{bmatrix} x_1(t) \\ \vdots \\ x_M(t) \end{bmatrix} = \begin{bmatrix} a_1(t) \\ \vdots \\ a_M(t) \end{bmatrix} \otimes s(t) \tag{4}$$

Further, when the order is N, Expression (4) is expressed by Expression (5).

$$\begin{bmatrix} x_1(N) \\ \vdots \\ x_M(N) \end{bmatrix} = \begin{bmatrix} a_{1[N]} & \cdots & a_{1[1]} \\ \vdots & \ddots & \vdots \\ a_{M[N]} & \cdots & a_{M[1]} \end{bmatrix} \begin{bmatrix} s_{[1]} \\ \vdots \\ s_{[N]} \end{bmatrix} \tag{5}$$

Further, Expression (4) is expressed by Expression (6) in a frequency domain.

$$\begin{bmatrix} X_1(\omega) \\ \vdots \\ X_M(\omega) \end{bmatrix} = \begin{bmatrix} A_1(\omega) \\ \vdots \\ A_M(\omega) \end{bmatrix} S(\omega) \tag{6}$$

Next, an estimation method of a transfer function in the present embodiment is described. In the present embodiment, the transfer function estimating unit 103 estimates a transfer function by using any of the following seven methods.

<TD Method>

First, a method in which the transfer function estimating unit 103 calculates a transfer function by using a regression model is described. The regression model is a model used when the correlation between independent values is examined or the like. The regression model is expressed by a product of a regressor (independent variable) and a base parameter which is an unknown parameter. The method described below is also referred to, hereinafter, as a TD (Time Domain) method.

First, when assuming first to N-th samples as one frame, an observation value $x_{[N]}{}^T$ of one frame in a time domain is expressed by Expression (7).

$$x_{[N]}{}^T = s_{[1:N]}{}^T a^T(t) \tag{7}$$

In Expression (7), $x_{[N]}{}^T$ is an observation value, $s_{[1:N]}{}^T$ is a regressor, and $a^T(t)$ is a base parameter, in the regression model. The $x_{[N]}{}^T$ is a value based on a sound signal collected by the first sound collecting unit 30, $s_{[1:N]}{}^T$ is a value based on a sound signal collected by the second sound collecting unit 20, and $a^T(t)$ is a transfer function to be obtained. In Expression (7), superscript T represents a transposed matrix.

Next, the observation values for F frames are expressed by Expression (8).

$$\begin{bmatrix} x^T_{[N|1]} \\ \vdots \\ x^T_{[N|F]} \end{bmatrix} = \begin{bmatrix} s^T_{[1:N|1]} \\ \vdots \\ s^T_{[1:N|F]} \end{bmatrix} a^T(t) \tag{8}$$

In Expression (8), the shift length between the frames is arbitrary, but the shift length for the TD method in the present embodiment is one in general. Therefore, in case of F frames, Expression (9) may be used.

$$\begin{bmatrix} x^T_{[N|1]} \\ \vdots \\ x^T_{[N|F]} \end{bmatrix} = \begin{bmatrix} s^T_{[1:N|1]} \\ \vdots \\ s^T_{[1:N|F]} \end{bmatrix} a^T(t) \tag{9}$$

In Expression (8), when the left-hand term is defined as $x_{[N|1:F]}$ and the right-hand term relating to s is defined as $\Phi$, a least square estimation value of the transfer function $a^T(t)$ which makes a residual error square sum minimum is expressed by Expression (10). That is, the transfer function estimating unit 103 estimates a transfer function by using Expression (10).

$$a^T(t) = (\Phi^T\Phi)^{-1}\Phi^T x_{[N|1:F]} \tag{10}$$

In Expression (10), $(\Phi^T\Phi)^{-1}\Phi^T$ is a pseudo inverse matrix of $\Phi$. That is, Expression (10) represents that the transfer function $a^T(t)$ is estimated by multiplying the observation value $x_{[N|1:F]}$ by the pseudo inverse matrix of $\Phi$.

In the present embodiment, only T samples from the beginning of samples in a signal are used. Hereinafter, T is referred to as a usage order.

Figure 5:
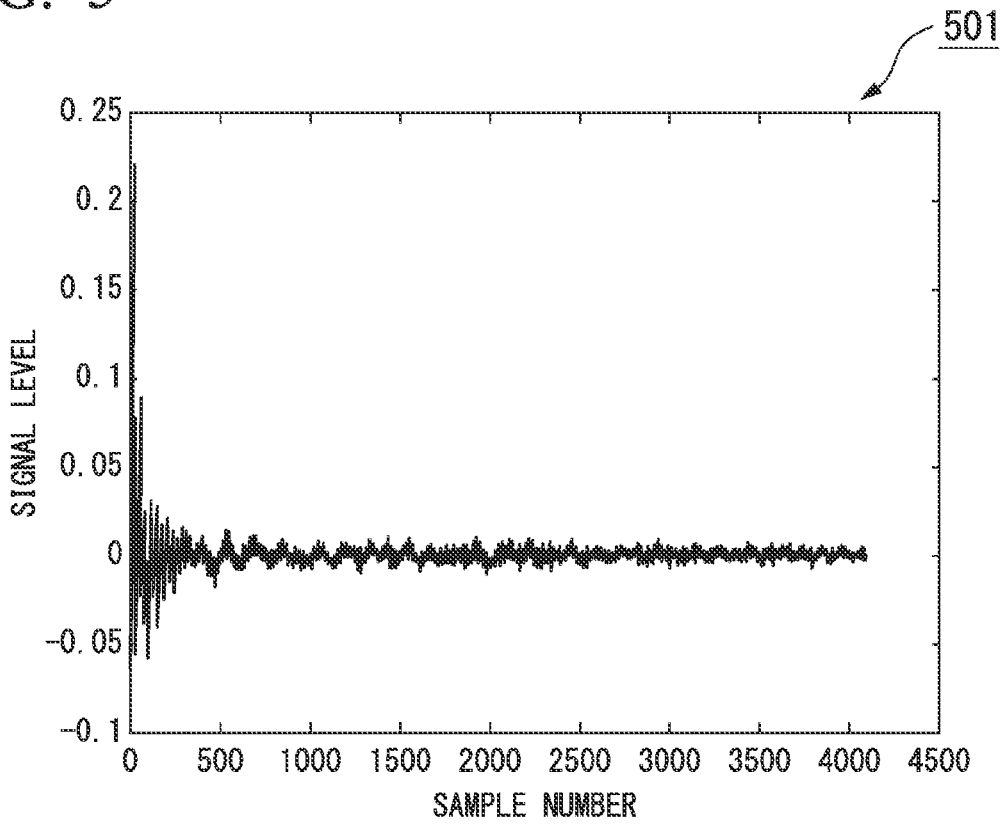
FIG. 5 is a diagram showing an example of characteristics of a transfer function calculated by a TD method.
Figure 5:
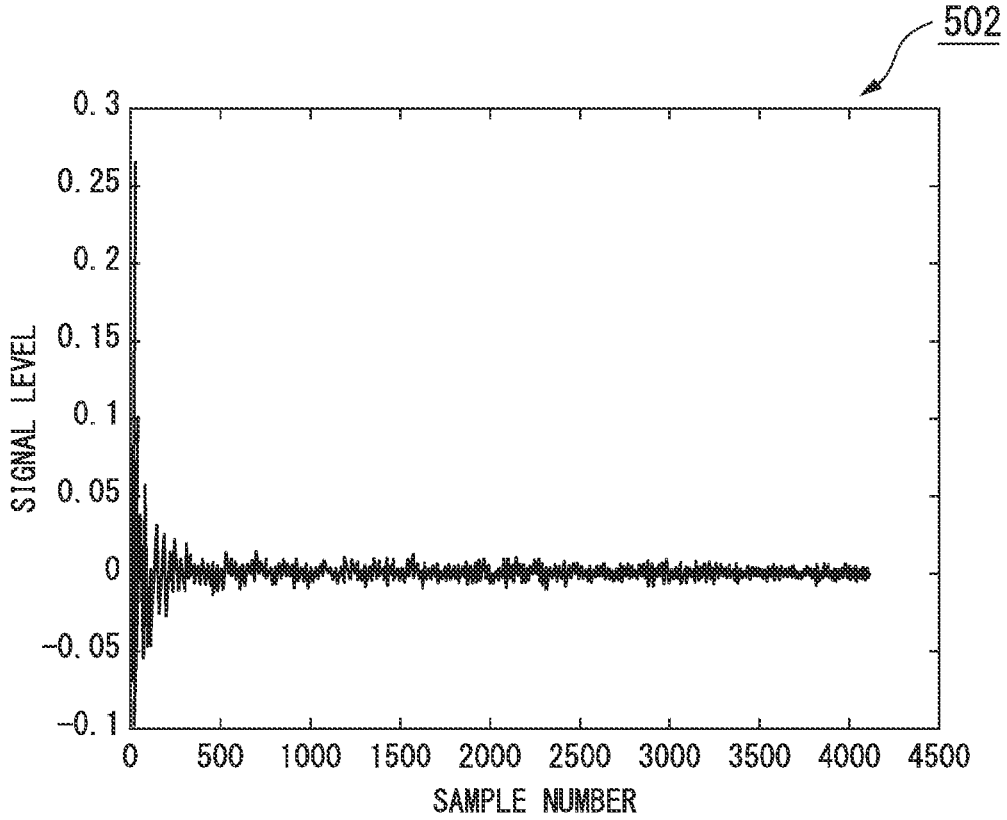

FIG. 5 is a diagram showing an example of characteristics of a transfer function calculated by the TD method. In FIG. 5, the horizontal axis represents a sample number, and the vertical axis represents signal intensity. In FIG. 5, an image of a region 501 represents a transfer function between the second sound collecting unit 20 and the first sound collecting unit 30 in a first channel, and an image of a region 502 represents a transfer function between the second sound collecting unit 20 and the first sound collecting unit 30 in a second channel. In the example of FIG. 5, the collected sound signal has an order of 4096 and a usage sample number of 16384×3. In the TD method, a usage order of 4096, a frame length of 4096, and a shift length of 1 are used. In the example of FIG. 5, the transfer function estimating unit 103 uses 4092 samples from the beginning as a transfer function.

In the present embodiment, an example is described in which estimation of a transfer function in a sound signal is performed. However, the present method can be applied to estimation of a transfer function in a non-linear model in the control of a mechanical system or the like. For example, according to the present embodiment, it is possible to estimate a parameter of a model, such as mass or inertia moment of an inverted pendulum which is one of non-linear mechanical systems, by using a regression model derived from Lagrange's motion equation.

<FD Method>

Next, a method in which the transfer function estimating unit 103 estimates a transfer function by using a complex regression model in a frequency domain is described. The complex regression model is a complexly extended model of the regression model in a time domain. The method described below is also referred to, hereinafter, as a FD (Frequency Domain) method.

First, when assuming first to N-th samples as one frame, an observation value $X_{[N]}{}^T$ of one frame in a frequency domain is expressed by Expression (11).

$$X_{[N]}{}^T = S_{[N]} A^T(\omega) \tag{11}$$

In Expression (11), $X_{[N]}{}^T$ is an observation value, $S_{[N]}$ is a regressor, and $A^T(\omega)$ is a base parameter, in the regression model. The $X_{[N]}{}^T$ is a value based on a sound signal collected by the first sound collecting unit 30, $S_{[N]}$ is a value based on a sound signal collected by the second sound collecting unit 20, and $A^T(\omega)$ is a transfer function to be obtained. In Expression (11), $S_{[N]}$ is a complex scalar.

Next, the observation values for F frames are expressed by Expression (12).

$$\begin{bmatrix} X^T_{[N|1]} \\ \vdots \\ X^T_{[N|F]} \end{bmatrix} = \begin{bmatrix} S_{[N|1]} \\ \vdots \\ S_{[N|F]} \end{bmatrix} A^T(\omega) \tag{12}$$

In Expression (12), when the left-hand term is defined as $x_{[N|1:F]}$ and the right-hand term relating to S is defined as $\Phi$, a least square estimation value of the transfer function $A^T(\omega)$ which makes a residual error square sum minimum is expressed by Expression (13). That is, the transfer function estimating unit 103 estimates a transfer function by using Expression (13).

$$A^T(\omega)=(\Phi^T\Phi)^{-1}\Phi^T x_{[N|1:F]} \tag{13}$$

Similar to Expression (10), Expression (13) represents that the transfer function $A^T(\omega)$ is estimated by multiplying the observation value $x_{[N|1:F]}$ by the pseudo inverse matrix of $\Phi$.

In the FD method described above, only T samples from the beginning of samples in a signal are used.

Figure 6:
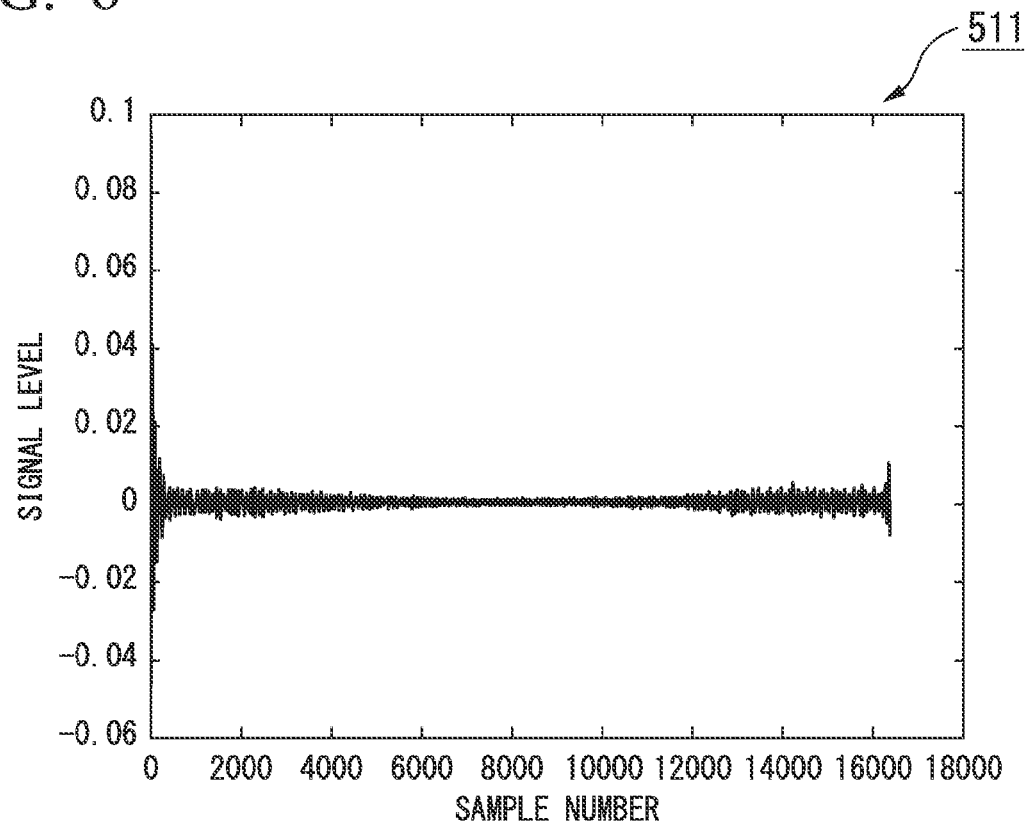
FIG. 6 is a diagram showing an example of characteristics of a transfer function calculated by a FD method.
Figure 6:
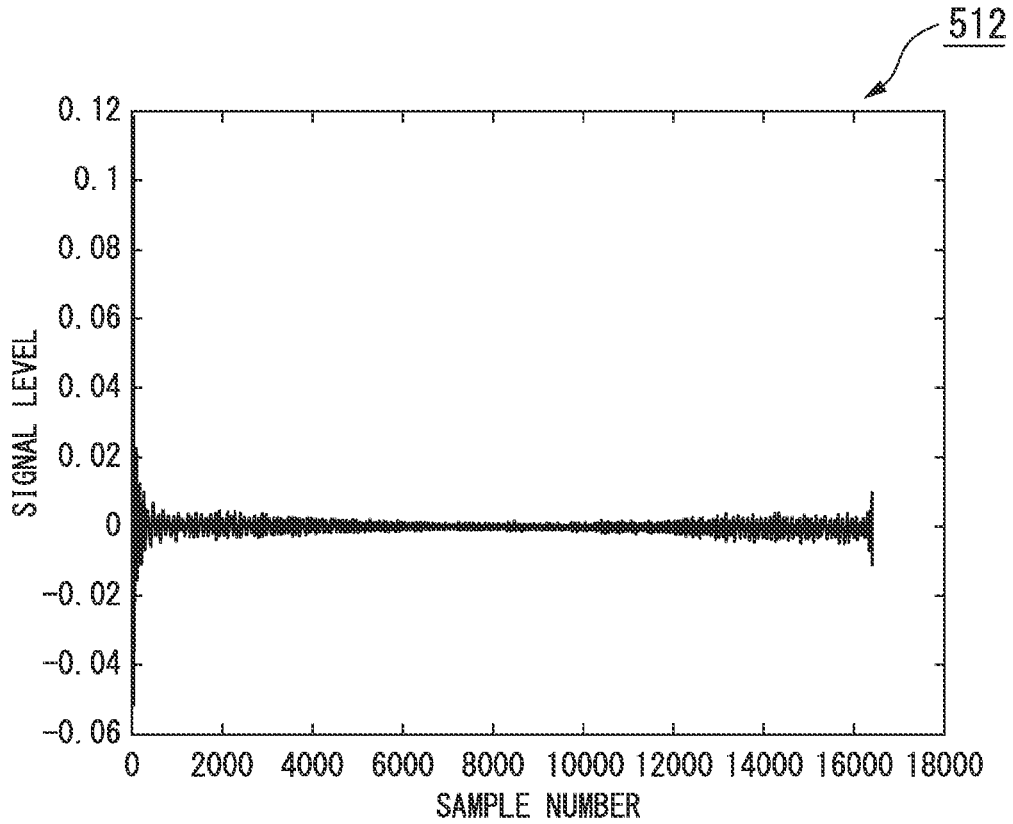

FIG. 6 is a diagram showing an example of characteristics of a transfer function calculated by the FD method. In FIG. 6, the horizontal axis represents a sample number, and the vertical axis represents signal intensity. In FIG. 6, an image of a region 511 represents a transfer function between the second sound collecting unit 20 and the first sound collecting unit 30 in a first channel, and an image of a region 512 represents a transfer function between the second sound collecting unit 20 and the first sound collecting unit 30 in a second channel. In the example of FIG. 6, the collected sound signal is the same as that of FIG. 5. In the FD method, a usage order of 4096, a frame length of 16384, a shift length of 10, and a window function of a Hamming function are used. In the example of FIG. 6, the transfer function estimating unit 103 uses 4092 samples from the beginning as a transfer function.

In the FD method described above, when $X_{[n]}{}^T$ is converted into $x_{[n]}{}^T$ by Fourier transform and when $S_{[n]}$ is converted into $s_{[n]}$ by Fourier transform, it is possible to use a window function. For example, a window function to be used is a Hamming window function. Thereby, in the FD method described above, since the number of samples cut from samples in a signal can be appropriately selected in use of estimation of a transfer function, it is possible to reduce a computation amount compared to the TD method.

Here, selection of a window function to be used is described.

The transfer function estimating unit 103 may predetermine a window function to be used. Alternatively, the transfer function estimating unit 103 may prepare a plurality of window functions to be used and may select any of the window functions depending on a sound field or a talker. For example, speech recognition may be performed by use of the configuration shown in FIG. 1, and a window function which provides a high recognition rate as a result of the speech recognition may be selected. Since in selection of a window function, there is a trade-off relation between fine frequency resolution and a wide dynamic range, an appropriate window function may be used corresponding to the situation.

The shift length between frames in the FD method may be arbitrary since a transfer function of a sound field is unchanged by time. When the shift length is long, a calculation amount can be reduced, but the performance of estimation is degraded since the number of frames used in estimation of a transfer function is reduced. Therefore, the shift length between frames in the FD method is appropriately set corresponding to a desired estimation accuracy.

In the FD method, since a regression model is used, a transfer function that makes a square error in an observation sample minimum can be obtained. Therefore, it is possible to estimate a transfer function having high accuracy.

<FDA Method>

Next, a method in which the transfer function estimating unit 103 estimates a transfer function by use of an addition average between frames in a frequency domain is described. The method described below is also referred to, hereinafter, as a FDA (Frequency Domain Average) method.

First, similar to the FD method, when assuming first to N-th samples as one frame, an observation value $X_{[N]}{}^T$ of one frame is the same as that of the FD method expressed by Expression (11). The observation values for F frames are the same as those of the FD method expressed by Expression (12).

The transfer function estimating unit 103 estimates a transfer function $A^T(\omega)$ by calculating an average of values obtained by dividing an output value by an input value, using Expression (14).

$$A^T(\omega)=\frac{1}{F}\sum_{f=1}^{F}\frac{X^T_{[N|f]}}{S_{[N|f]}} \tag{14}$$

Expression (14) represents that a transfer function $A^T(\omega)$ is estimated by calculating an average value of values, each of the values being obtained in each frame by dividing a value $X_{[N]}{}^T$ based on a sound signal collected by the first sound collecting unit 30 which is an output value, by a value $S_{[N]}$ based on a sound signal collected by the second sound collecting unit 20 which is an input value.

The transfer function $A^T(\omega)$ is converted into N samples by inverse Fourier transform. In the present embodiment, only T samples from the beginning of samples in a signal are used.

Figure 7:
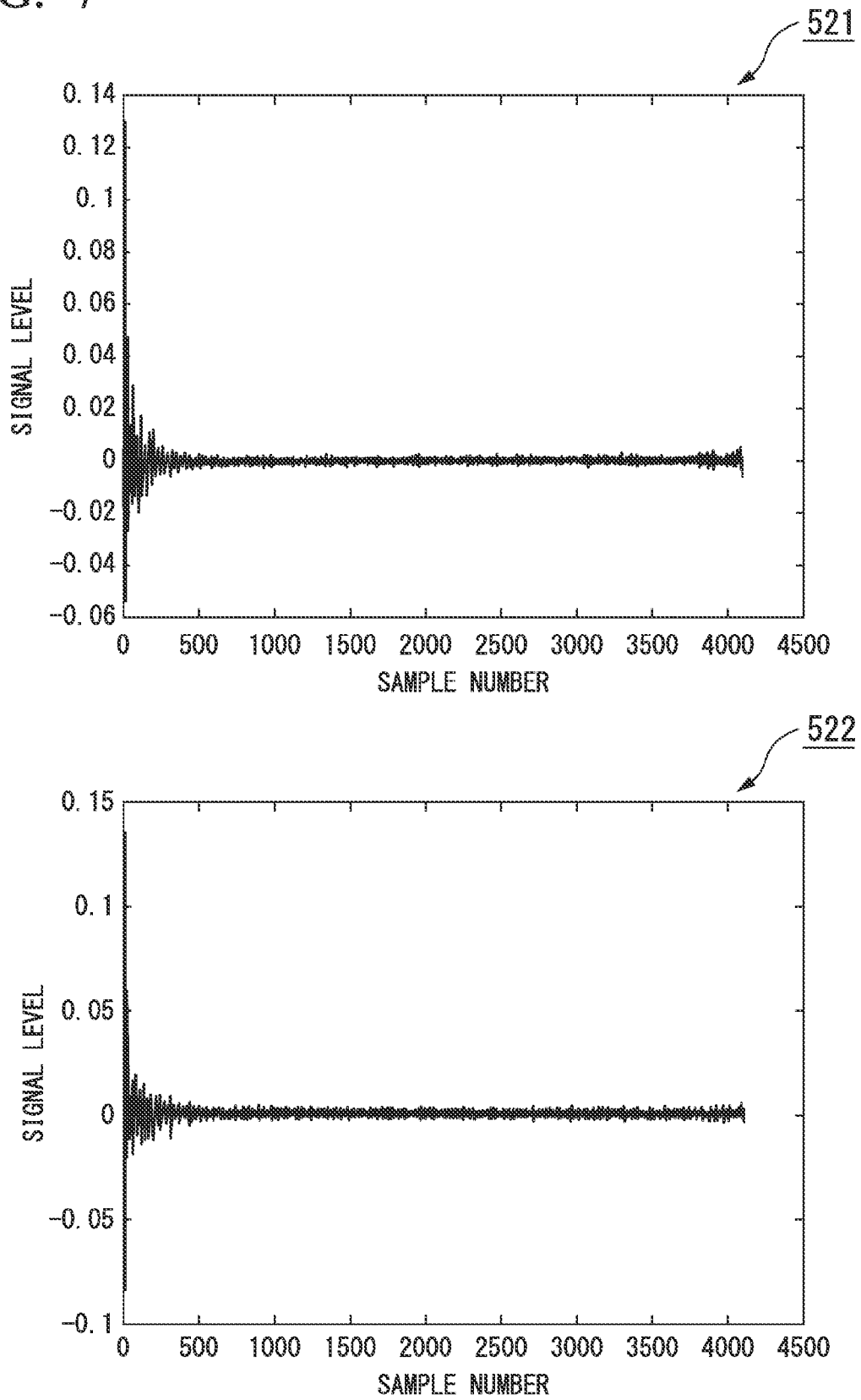
FIG. 7 is a diagram showing an example of characteristics of a transfer function calculated by a FDA method.

FIG. 7 is a diagram showing an example of characteristics of a transfer function calculated by the FDA method. In FIG. 7, the horizontal axis represents a sample number, and the vertical axis represents signal intensity. In FIG. 7, an image of a region 521 represents a transfer function between the second sound collecting unit 20 and the first sound collecting unit 30 in a first channel, and an image of a region 522 represents a transfer function between the second sound collecting unit 20 and the first sound collecting unit 30 in a second channel. In the example of FIG. 7, the collected sound signal is the same as that of FIG. 5. In the FDA method, a usage order of 4096, a frame length of 4096, a shift length of 10, and a window function of a Hamming function are used. In the example of FIG. 7, the transfer function estimating unit 103 uses 4092 samples from the beginning as a transfer function.

In the FDA method described above, similar to the FD method, when $X_{[n]}{}^T$ is converted into $x_{[n]}{}^T$ by Fourier transform and when $S_{[n]}$ is converted into $s_{[n]}$ by Fourier transform, it is possible to use a window function. For example, a window function to be used is a Hamming window function. Thereby, in the FDA method described above, since the number of samples cut from samples in a signal can be appropriately selected in use of estimation of a transfer function, it is possible to reduce a computation amount compared to the TD method.

Also in the FDA method, the shift length between frames may be arbitrary since a transfer function of a sound field is unchanged by time. When the shift length is long, the calculation amount can be reduced, but the performance of estimation is degraded since the number of frames used in estimation of a transfer function is reduced. Therefore, the shift length between frames in the FDA method is appropriately set corresponding to a desired estimation accuracy.

<FDN Method>

Next, a method in which the transfer function estimating unit 103 estimates a transfer function by use of an addition average between frames in a frequency domain is described. The method described below is also referred to, hereinafter, as a FDN (Frequency Domain Normalize) method.

First, similar to the FD method, when assuming first to N-th samples as one frame, an observation value $X_{[N]}^T$ of one frame is the same as that of the FD method expressed by Expression (11). The observation values for F frames are the same as those of the FD method expressed by Expression (12).

The transfer function estimating unit 103 estimates a transfer function $A^T(\omega)$ by calculating an average value of output values and an average value of input values separately and dividing the calculated output average value by the calculated input average value, using Expression (15).

$$A^T(\omega) = \frac{\sum_{f=1}^{F} X_{[N|f]}^T}{\sum_{f=1}^{F} S_{[N|f]}} \tag{15}$$

Expression (15) represents that a transfer function $A^T(\omega)$ is estimated by dividing an average value of values $X_{[N]}^T$ by an average value of values $S_{[N]}$, each of the values $X_{[N]}^T$ being obtained in each frame based on a sound signal collected by the first sound collecting unit 30 and being an output value, and each of the values $S_{[N]}$ being obtained in each frame based on a sound signal collected by the second sound collecting unit 20 and being an input value.

The transfer function $A^T(\omega)$ is converted into N samples by inverse Fourier transform. In the present embodiment, only T samples from the beginning of samples in a signal are used.

Figure 8:
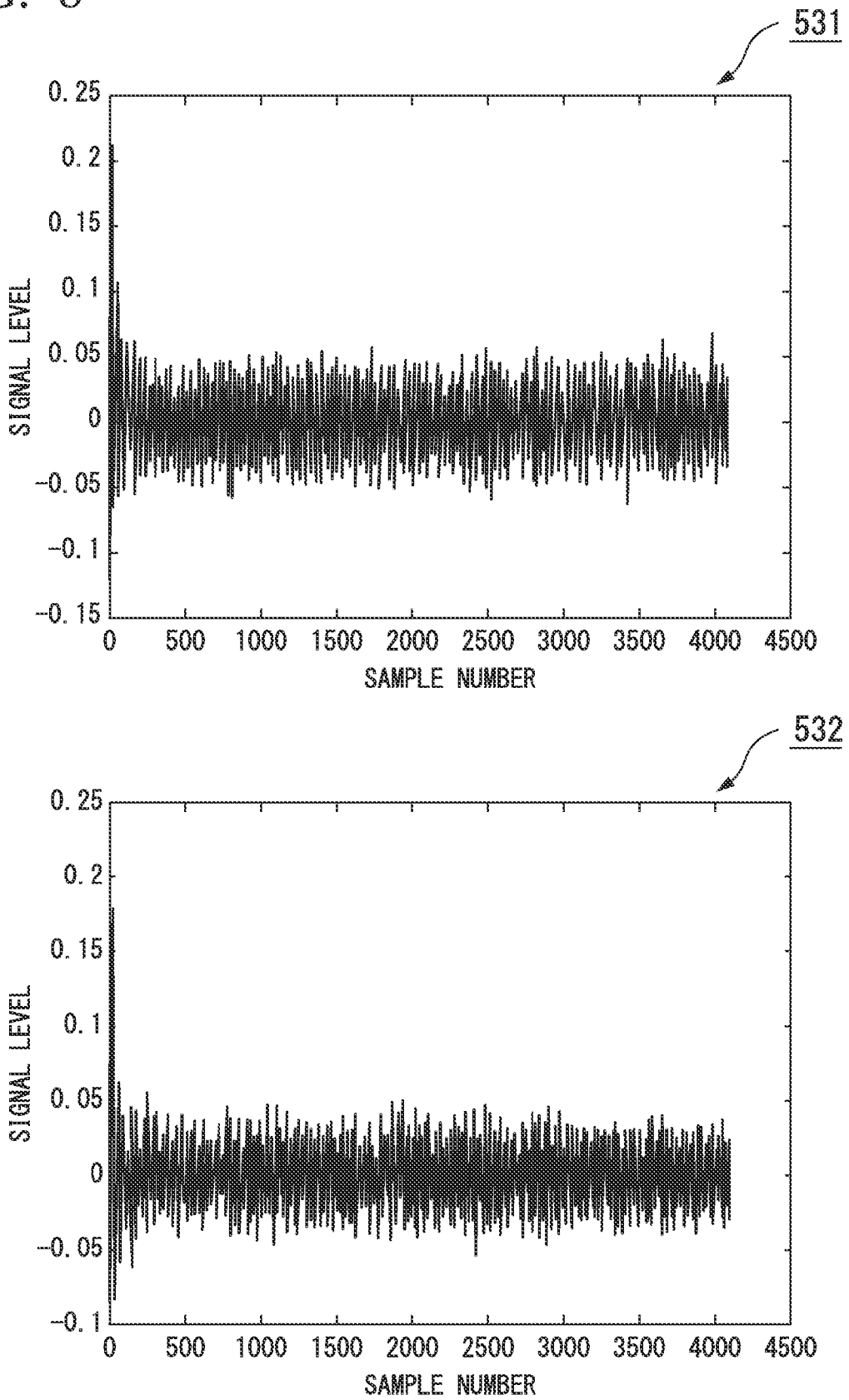
FIG. 8 is a diagram showing an example of characteristics of a transfer function calculated by a FDN method.

FIG. 8 is a diagram showing an example of characteristics of a transfer function calculated by the FDN method. In FIG. 8, the horizontal axis represents a sample number, and the vertical axis represents signal intensity. In FIG. 8, an image of a region 531 represents a transfer function between the second sound collecting unit 20 and the first sound collecting unit 30 in a first channel, and an image of a region 532 represents a transfer function between the second sound collecting unit 20 and the first sound collecting unit 30 in a second channel. In the example of FIG. 8, the collected sound signal is the same as that of FIG. 5. In the FDN method, a usage order of 4096, a frame length of 16384, a shift length of 16384, and a window function of a Hamming function are used. In the example of FIG. 8, the transfer function estimating unit 103 uses 4092 samples from the beginning as a transfer function.

In the FDN method described above, similar to the FD method, when $X_{[n]}^T$ is converted into $x_{[n]}^T$ by Fourier transform and when $S_{[n]}$ is converted into $s_{[n]}$ by Fourier transform, it is possible to use a window function. For example, a window function to be used is a Hamming window function. Thereby, in the FDN method described above, since the number of samples cut from samples in a signal can be appropriately selected in use of estimation of a transfer function, it is possible to reduce a computation amount compared to the TD method.

Also in the FDN method, the shift length between frames may be arbitrary since a transfer function of a sound field is unchanged by time. When the shift length is long, a calculation amount can be reduced, but the performance of estimation is degraded since the number of frames used in estimation of a transfer function is reduced. Therefore, the shift length between frames in the FDN method is appropriately set based on the desired estimation accuracy.

<FDP Method>

Next, a method in which the transfer function estimating unit 103 estimates a transfer function by use of an addition average between frames in a frequency domain is described. The method described below is also referred to, hereinafter, as a FDP (Frequency Domain Phase Average) method.

First, similar to the FD method, when assuming first to N-th samples as one frame, an observation value $X_{[N]}^T$ of one frame is the same as that of the FD method expressed by Expression (11). The observation values for F frames are the same as those of the FD method expressed by Expression (12).

By using an amplitude value which is an averaged value between frames and selecting a phase of the most probably reliable frame (assume the frame as the k-th frame; here, k is a value equal to or more than 1 and equal to or less than F), a transfer function $A^T(\omega)$ is expressed by Expression (16).

$$A^T(\omega) = \frac{\sum_{f=1}^{F} |X_{[N|f]}^T| \angle X_{[N|k]}^T}{\sum_{f=1}^{F} |S_{[N|f]}| \angle S_{[N|k]}} \tag{16}$$

In Expression (16), $\angle$ represents a phase angle. In the right-hand first term of Expression (16), an average value of absolute values of $X_{[N]}^T$, each of the absolute values of $X_{[N]}^T$ being obtained in each frame based on a sound signal collected by the first sound collecting unit 30, is divided by an average value of absolute values of $S_{[N]}$, each of the absolute values of $S_{[N]}$ being obtained in each frame based on a sound signal collected by the second sound collecting unit 20. That is, the right-hand first term represents averaging amplitudes between frames.

Next, the right-hand second term represents that a phase angle of a value $X_{[N]}^T$ in the probably reliable k-th frame based on a sound signal collected by the first sound collecting unit 30 is divided by a phase angle of a value $S_{[N]}$ in the probably reliable k-th frame based on a sound signal collected by the second sound collecting unit 20.

Then, by multiplying the right-hand first term by the right-hand second term, a transfer function $A^T(\omega)$ is estimated.

The transfer function estimating unit 103 selects the most probably reliable k-th frame based on a selection index. As the selection index, it is possible to select a frame having a large power over the entire region of the usage frequency band.

The transfer function $A^T(\omega)$ is converted into N samples by inverse Fourier transform. In the present embodiment, only T samples from the beginning of samples in a signal are used.

Figure 9:
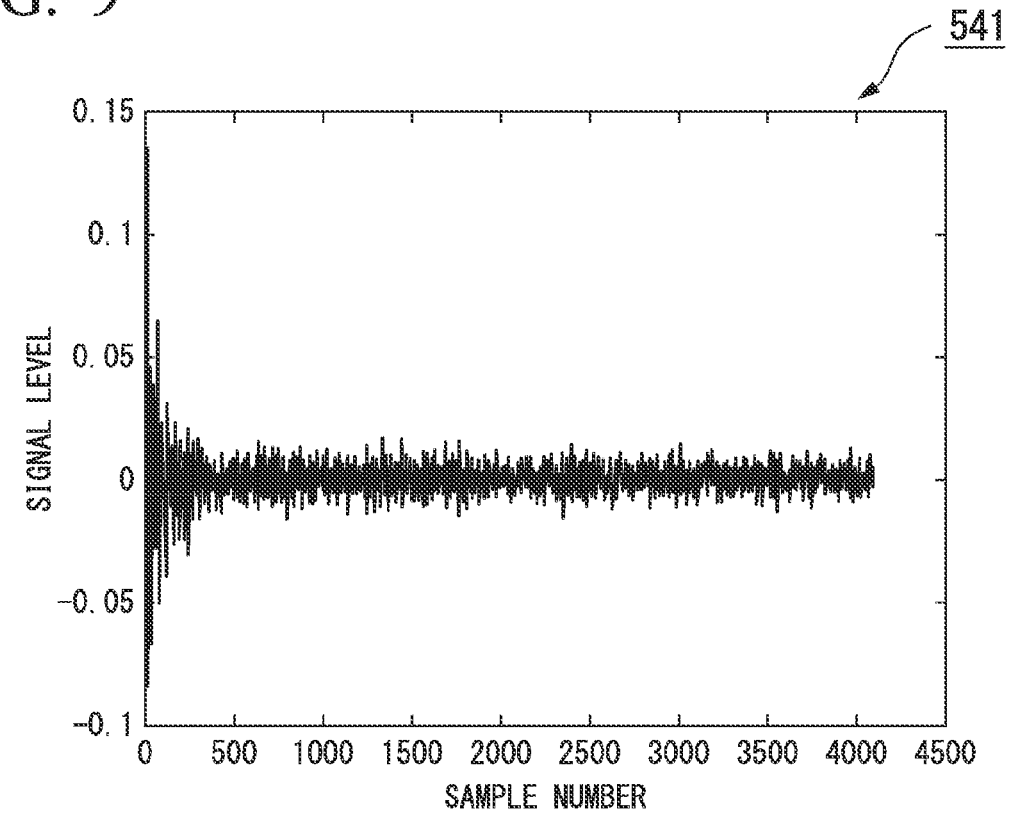
FIG. 9 is a diagram showing an example of characteristics of a transfer function calculated by a FDP method.
Figure 9:
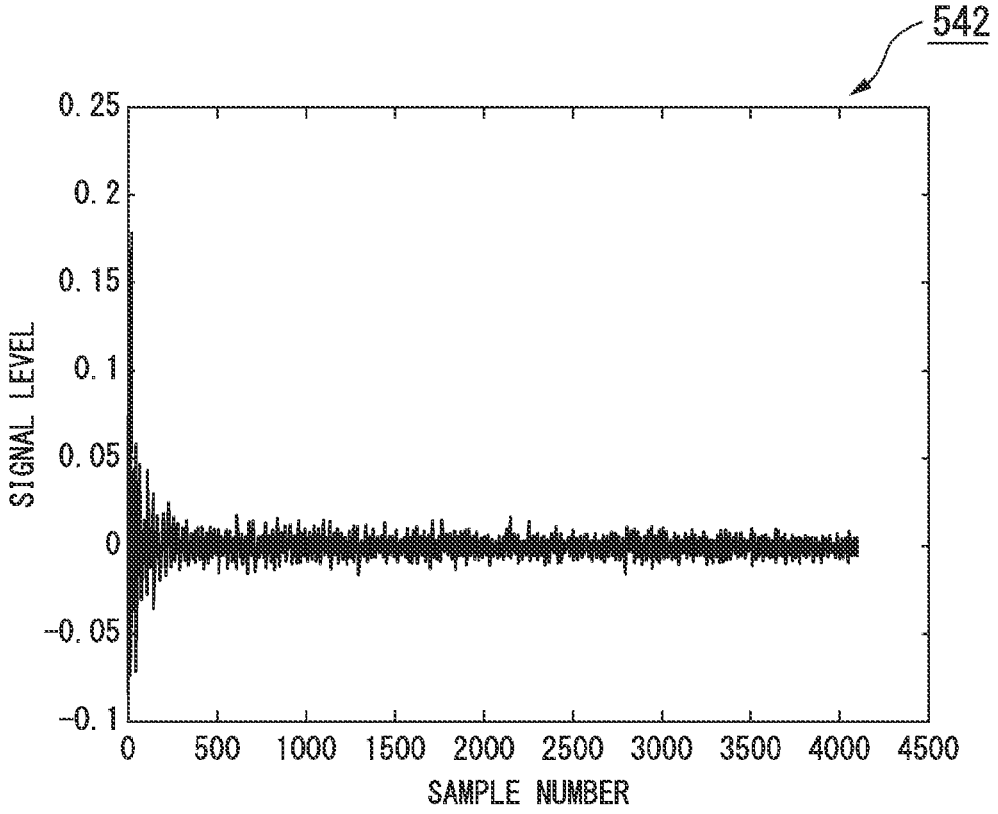

FIG. 9 is a diagram showing an example of characteristics of a transfer function calculated by the FDP method. In FIG. 9, the horizontal axis represents a sample number, and the vertical axis represents signal intensity. In FIG. 9, an image of a region 541 represents a transfer function between the second sound collecting unit 20 and the first sound collecting unit 30 in a first channel, and an image of a region 542 represents a transfer function between the second sound collecting unit 20 and the first sound collecting unit 30 in a second channel. In the example of FIG. 9, the collected sound signal is the same as that of FIG. 5. In the FDP method, a usage order of 4096, a frame length of 16384, a shift length of 16384, and a window function of a Hamming function are used. In the example of FIG. 9, the transfer function estimating unit 103 uses 4092 samples from the beginning as a transfer function.

According to the FDP method described above, similar to the FD method or the like, it is possible to multiply a window for converting $X_{[n]}^T$ into $x_{[n]}^T$ by Fourier transform. Similarly, it is possible to multiply a window for converting $S_{[n]}$ into $s_{[n]}$ by Fourier transform. Therefore, in the FDP method, it is possible to reduce a computation amount compared to the TD method.

Also in the FDP method, the shift length between frames may be arbitrary since a transfer function of a sound field is unchanged by time. When the shift length is long, a calculation amount can be reduced, but the performance of estimation is degraded since the number of frames used in estimation of a transfer function is reduced. Therefore, the shift length between frames in the FDP method is appropriately set corresponding to a desired estimation accuracy.

<FDC Method>

Next, a method in which the transfer function estimating unit 103 estimates a transfer function by use of an addition average between frames in a frequency domain, which is further applied with a cross spectrum method, is described. The method described below is also referred to, hereinafter, as a FDC (Frequency Domain Cross Spectrum) method.

First, similar to the FD method, when assuming first to N-th samples as one frame, an observation value $X_{[N]}^T$ of one frame is the same as that of the FD method expressed by Expression (11). The observation values for F frames are the same as those of the FD method expressed by Expression (12).

By using the cross spectrum method, a transfer function $A(\omega)$ is expressed by Expression (17). In Expression (17), superscript * (asterisk) represents the complex conjugate.

$$A(\omega) = \frac{\sum_{f=1}^{F} |S^*_{[N|f]} X_{[N|k]}|}{\sum_{f=1}^{F} |S^*_{[N|f]} S_{[N|k]}|} \tag{17}$$

The cross spectrum method is described.

A power spectrum density function $S_x(f)$ can be obtained by applying Fourier transform on an autocorrelation function $R_x$, and a cross spectrum density $S_{xy}(f)$ can be obtained by applying Fourier transform on a crosscorrelation function $R_{xy}$.

Further, according to the convolution theorem in which a convolution relation in a time domain is a product relation in a frequency domain, the cross spectrum density $S_{xy}(f)$ is represented by a frequency domain expression of an impulse response, that is, the product of a transfer function H(f) and the power spectrum density function $S_x(f)$.

Further, according to the Fourier transform relation between the power spectrum density and the signal, the power spectrum density function $S_x(f)$ is represented by Expression (18), and the cross spectrum density $S_{xy}(f)$ is represented by Expression (19).

$$S_x(f)=E|X^*(f)X(f)| \tag{18}$$

$$S_{xy}(f)=E|X^*(f)Y(f)| \tag{19}$$

That is, by applying Fourier transform on the observed input signal x(t) and the observed output signal y(t), or applying Fourier transform on a discrete time expression x(n) of the signal x(t) and a discrete time expression y(n) of the signal y(t), and performing calculations of Expression (18) and Expression (19), estimation of the impulse response can be performed.

In Expression (17) described above, the denominator of the right-hand term is the sum of Expression (18), and the numerator corresponds to the sum of Expression (19). Accordingly, by dividing the sum of Expression (18) by the sum of Expression (19), the transfer function $H(f)=A(\omega)$ can be calculated.

The transfer function $A^T(\omega)$ is converted into N samples by inverse Fourier transform. In the present embodiment, only T samples from the beginning of samples in a signal are used.

Figure 10:
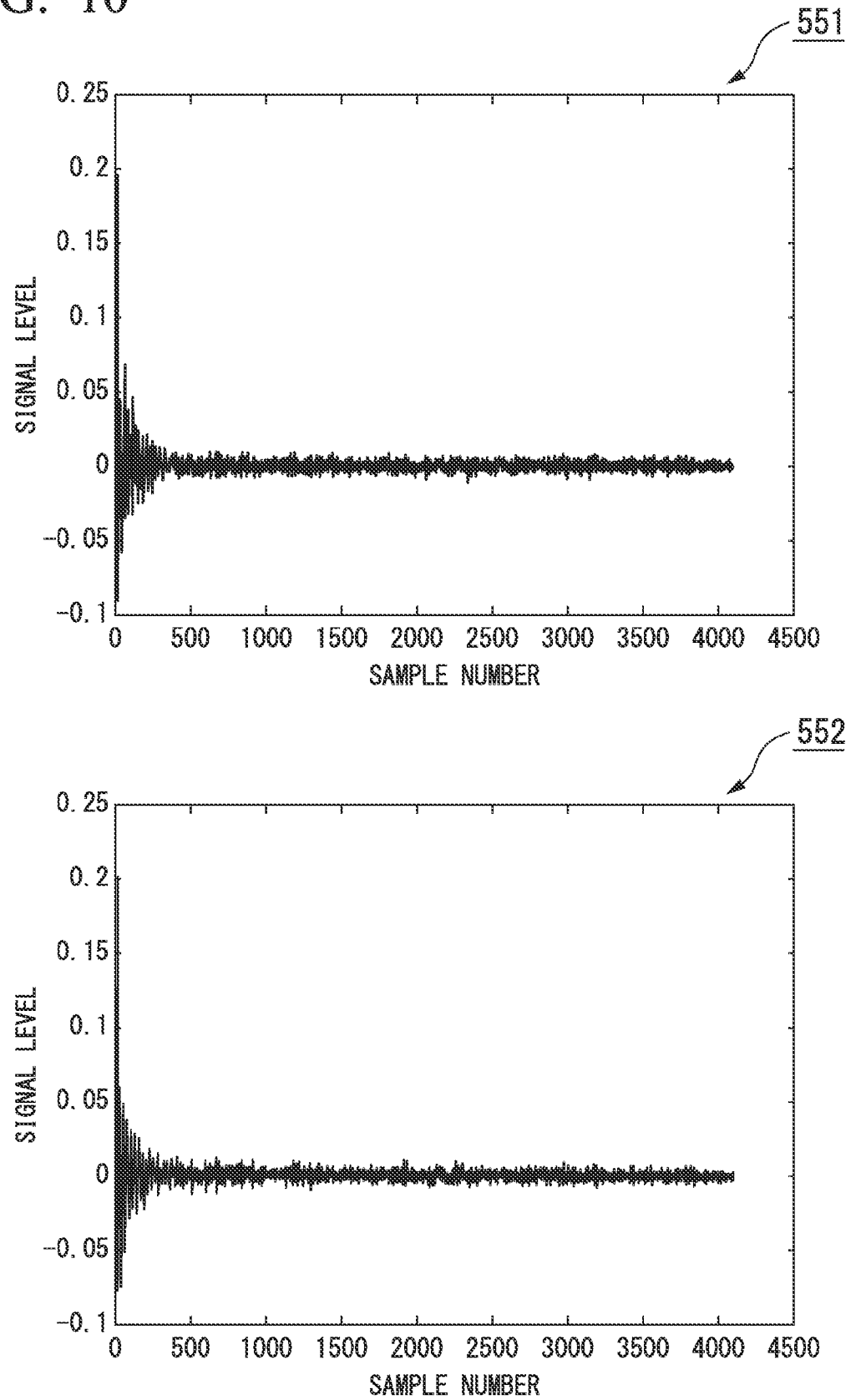
FIG. 10 is a diagram showing an example of characteristics of a transfer function calculated by a FDC method.

FIG. 10 is a diagram showing an example of characteristics of a transfer function calculated by the FDC method. In FIG. 10, the horizontal axis represents a sample number, and the vertical axis represents signal intensity. In FIG. 10, an image of a region 551 represents a transfer function between the second sound collecting unit 20 and the first sound collecting unit 30 in a first channel, and an image of a region 552 represents a transfer function between the second sound collecting unit 20 and the first sound collecting unit 30 in a second channel. In the example of FIG. 10, the collected sound signal is the same as that of FIG. 5. In the FDC method, a usage order of 4096, a frame length of 16384, a shift length of 16384, and a window function of a Hamming function are used. In the example of FIG. 10, the transfer function estimating unit 103 uses 4092 samples from the beginning as a transfer function.

As described above, according to the FDC method, similar to the FD method or the like, it is possible to multiply a window for converting $X_{[n]}^T$ into $x_{[n]}^T$ by Fourier transform. Similarly, it is possible to multiply a window for converting $S_{[n]}$ into $s_{[n]}$ by Fourier transform. Therefore, in the FDC method, it is possible to reduce a computation amount compared to the TD method.

Also in the FDC method, the shift length between frames may be arbitrary since a transfer function of a sound field is unchanged by time. When the shift length is long, a calculation amount can be reduced, but the performance of estimation is degraded since the number of frames used in estimation of a transfer function is reduced. Therefore, the shift length between frames in the FDC method is appropriately set corresponding to a desired estimation accuracy.

<FDS Method>

Next, a method in which the transfer function estimating unit 103 estimates a transfer function by use of one frame in a frequency domain is described. The method described below is also referred to, hereinafter, as a FDS (Frequency Domain Single Frame) method.

First, similar to the FD method, when assuming first to N-th samples as one frame, an observation value $X_{[N]}^T$ of one frame is the same as that of the FD method expressed by Expression (11).

According to Expression (11), a transfer function $A^T(\omega)$ for one frame is calculated. The calculated transfer function is expressed by Expression (20).

$$A^T(\omega) = \frac{X^T_{[N]}}{S_{[N]}} \tag{20}$$

Since a transfer function is estimated by the observation value only for one frame, the number of samples in one frame can be greater than that used in the FD method or the like.

Figure 11:
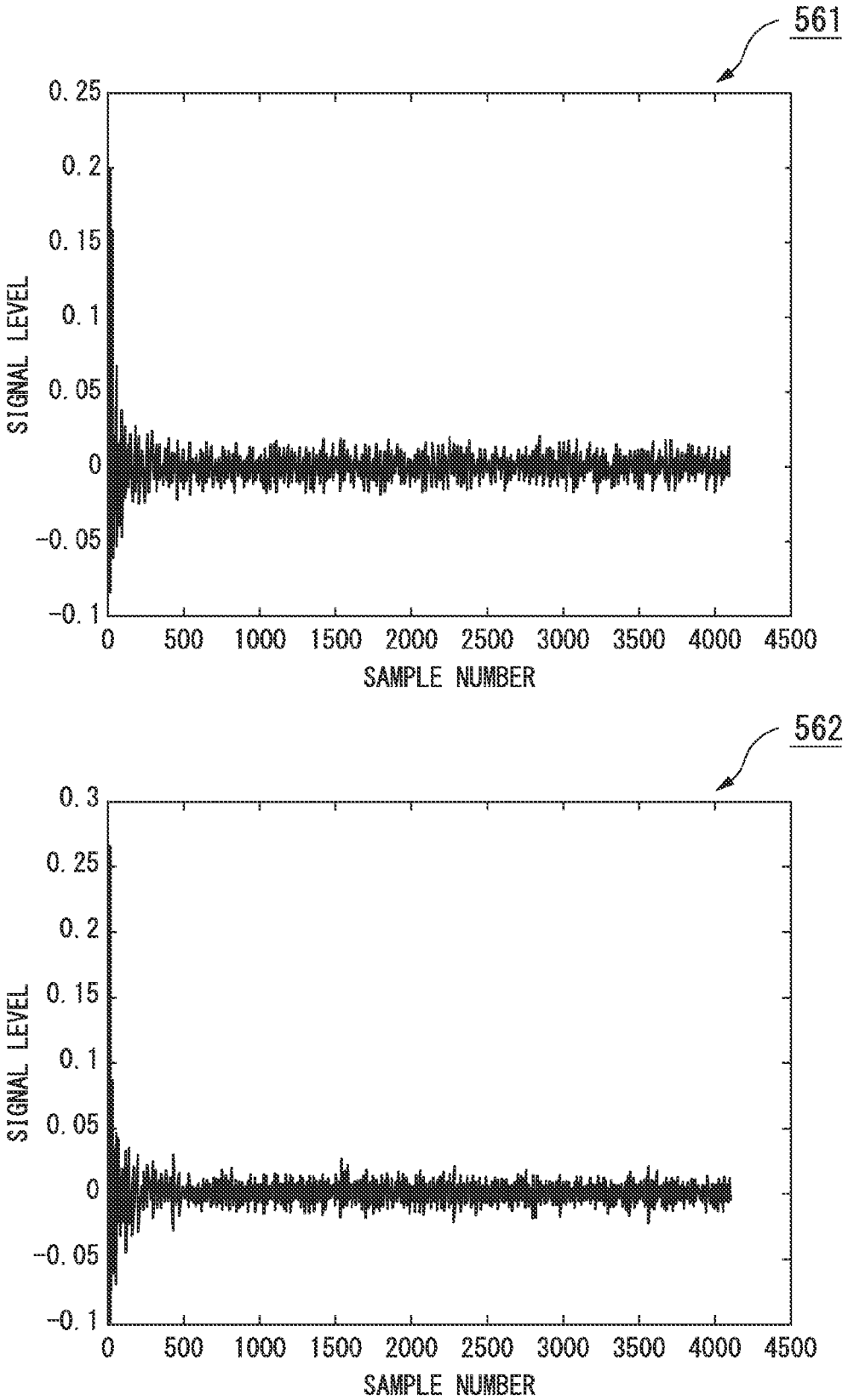
FIG. 11 is a diagram showing an example of characteristics of a transfer function calculated by a FDS method.

FIG. 11 is a diagram showing an example of characteristics of a transfer function calculated by the FDS method. In FIG. 11, the horizontal axis represents a sample number, and the vertical axis represents signal intensity. In FIG. 11, an image of a region 561 represents a transfer function between the second sound collecting unit 20 and the first sound collecting unit 30 in a first channel, and an image of a region 562 represents a transfer function between the second sound collecting unit 20 and the first sound collecting unit 30 in a second channel. In the example of FIG. 11, the collected sound signal is the same as that of FIG. 5. In the FDS method, a usage order of 4096, a frame length of 16384×3, and a window function of a Hamming function are used. In the example of FIG. 11, the transfer function estimating unit 103 uses 4092 samples from the beginning as a transfer function.

Figure 12:
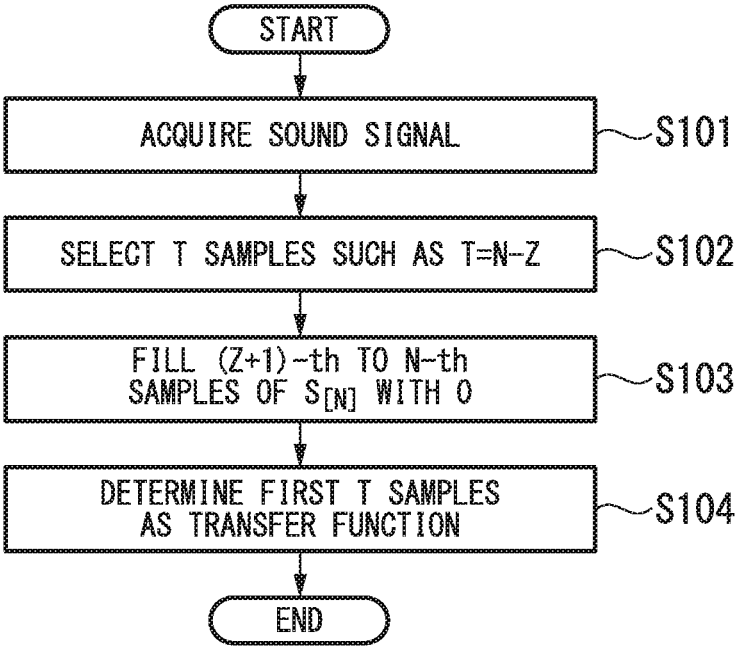
FIG. 12 is a flowchart of a process sequence performed by a transmission function estimating unit in the FDS method according to the first embodiment.

Next, a process sequence performed by the transmission function estimating unit 103 in the FDS method is described. FIG. 12 is a flowchart of a process sequence performed by the transmission function estimating unit 103 in the FDS method according to the present embodiment. The sound signal collected by the second sound collecting unit 20 and the sound signal collected by the first sound collecting unit 30 include first to Z-th samples.

(Step S101) The second sound signal acquiring unit 101 acquires a sound signal, and the first sound signal acquiring unit 102 acquires a sound signal.

(Step S102) The transfer function estimating unit 103 selects T samples such as N−Z=T. T is a usage order which is employed lastly as a transfer function.

(Step S103) In order to reduce reverberation of $X_{[N]}$ which is on the output side, the transfer function estimating unit 103 fills (Z+1)-th to N-th samples of $S_{[N]}$ with 0. The transfer function estimating unit 103 uses $X_{[N]}$ as is.

(Step S104) The transfer function estimating unit 103 performs inverse Fourier transform by using Expression (20) and determines first T samples as a transfer function.

As described above, according to the FDS method, similar to the FD method or the like, it is possible to multiply a window for converting $X_{[n]}{}^T$ into $x_{[n]}{}^T$ by Fourier transform. Similarly, it is possible to multiply a window for converting $S_{[n]}$ into $s_{[n]}$ by Fourier transform. Therefore, in the FDS method, it is possible to reduce a computation amount compared to the TD method.

As described above, the sound processing apparatus 10 of the present embodiment includes: the first sound collecting unit 30 that is placed in a sound field and collects a sound signal which is speech of a talker; the second sound collecting unit 20 that is arranged to be movable to a position which is closer to a talker than the first sound collecting unit 30 and collects the sound signal; the transfer function estimating unit 103 that estimates a transfer function from a sound signal collected by the first sound collecting unit 30 and a sound signal collected by the second sound collecting unit 20 when a talker is at a predetermined position in the sound field; and a sound signal processing unit (sound source localizing unit 104, sound source separating unit 105, sound feature value extracting unit 106, speech recognizing unit 107) that performs a process of the sound signal by use of the transfer function estimated by the transfer function estimating unit 103.

In addition, in the sound processing apparatus 10 of the present embodiment, the second sound collecting unit 20 is arranged at a position where the direct sound of a talker can be collected.

According to this configuration, the sound processing apparatus 10 of the present embodiment is capable of accurately estimating a transfer function in a sound field.

Next, a test result is described in a case where the sound processing apparatus 10 of the present embodiment is used.

Figure 13:
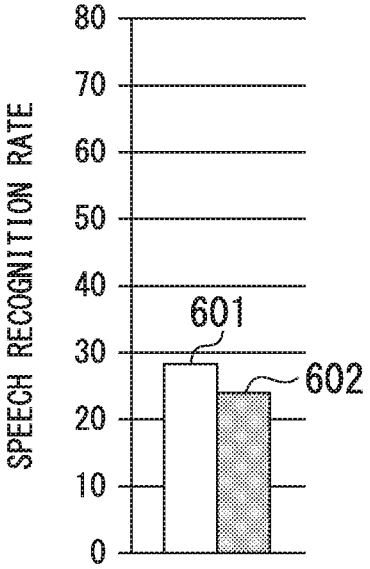
FIG. 13 is a diagram showing an example of a speech recognition rate in a conventional case where speech emitted from a loudspeaker is collected by a microphone to estimate a transfer function.
Figure 14:
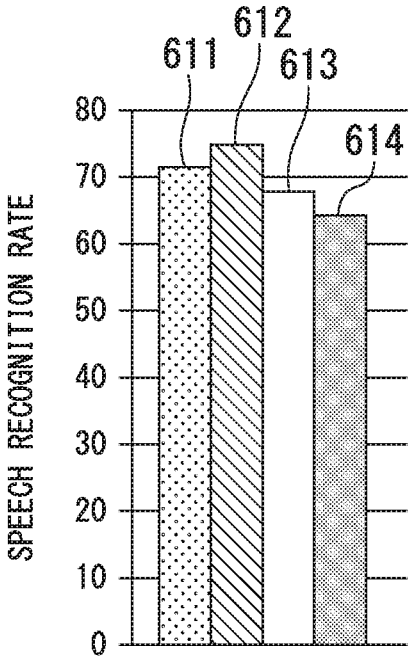
FIG. 14 is a diagram showing an example of a speech recognition rate in a case where the sound processing apparatus is used according to the first embodiment.

FIG. 13 is a diagram showing an example of a speech recognition rate in a conventional case where speech emitted from a loudspeaker is collected by a microphone to estimate a transfer function. FIG. 14 is a diagram showing an example of a speech recognition rate in a case where the sound processing apparatus 10 according to the present embodiment is used. In the example of FIG. 14, the transfer function estimating unit 103 estimated a transfer function by using the FD method. The reason for using the FD method is that, as a result of evaluation, the highest speech recognition rate was obtained by the FD method of the seven methods described above.

In FIG. 13, an image 601 represents a speech recognition rate of a first measurement point, and an image 602 represents a speech recognition rate of a second measurement point.

In FIG. 13, the horizontal axis represents a measurement point, and the vertical axis represents a speech recognition rate. In FIG. 14, the horizontal axis represents a talker, and the vertical axis represents a speech recognition rate. An image 611 represents a speech recognition rate of a first talker, an image 612 represents a speech recognition rate of a second talker, an image 613 represents a speech recognition rate of a third talker, and an image 614 represents a speech recognition rate of a fourth talker.

As shown in FIG. 13, the speech recognition rate of the conventional technique was about 28% at the first measurement point and was about 25% at the second measurement point.

On the other hand, as shown in FIG. 14, according to the present embodiment, the speech recognition rate of the first talker was about 72%, the speech recognition rate of the second talker was about 74%, the speech recognition rate of the third talker was about 67%, and the speech recognition rate of the fourth talker was about 64%.

Thus, according to the sound processing apparatus 10 of the present embodiment, it was possible to improve the speech recognition rate by about 40% compared to the conventional technique.

Estimation of a transfer function by use of the methods described above may be performed only at the first time. The transfer function estimating unit 103 may cause the storage unit 109 to store the estimated transfer function and may use the transfer function stored in the storage unit 109 at and after the second time. The measurement at the first time may be performed, for example, at the time of adjusting the seat position of a vehicle inside or the like, in accordance with a command from a control unit which performs a variety of control of the vehicle.

In addition, in a case where the second sound collecting unit 20 is a mobile phone such as a smartphone, when a driver makes a phone call with the mobile phone while stopping the vehicle, the transfer function estimating unit 103 may acquire a sound signal and may estimate a transfer function. Further, when a driver makes a phone call with a mobile phone, the transfer function may be sequentially updated.

In addition, in the present embodiment, only a driver is described as an example of a talker. However, a transfer function can be estimated as described above with respect to a sound signal of a person seated at a passenger seat, a rear seat, or the like. In this case, for example, the transfer function estimating unit 103 may switch one of the transfer functions stored in the storage unit 109 to another, corresponding to a result of operation of the operation unit (not shown) by the driver or another person.

In the first embodiment, an example is described in which the transfer function estimating unit 103 estimates a transfer function by using one of the methods described above; however, the embodiment is not limited thereto. The transfer function estimating unit 103 may estimate a transfer function by using two or more of the methods.

For example, the transfer function estimating unit 103 may integrate the FD method and the TD method and may estimate a transfer function as described below. The transfer function estimating unit 103 integrates A(ω) and a(t) obtained by least square estimation. Then, the transfer function estimating unit 103 performs analogical reasoning at the time of transfer function interpolation. Further, the transfer function estimating unit 103 calculates an accuracy of phase in the FD method and an accuracy of amplitude in the TD method. Then, the transfer function estimating unit 103 compares the calculated accuracy of phase or accuracy of amplitude with a predetermined accuracy. The transfer function estimating unit 103 estimates a transfer function by the FD method when the accuracy of phase is better than the predetermined accuracy. On the other hand, the transfer function estimating unit 103 estimates a transfer function by the TD method when the accuracy of amplitude is better than the predetermined accuracy.

The first embodiment is described using an example in which a sound signal uttered by a talker is collected by use of the second sound collecting unit 20 and the first sound collecting unit 30, and a transfer function is estimated based on the collected sound signal; however, the embodiment is not limited thereto. For example, the first sound collecting unit 30 acquires a sound signal emitted from a loudspeaker instead of a talker. Then, the transfer function estimating unit 103 may obtain a transfer function by using the acquired sound signal as an observation value and may integrate the obtained transfer function and an estimated transfer function by any of the methods described above.

The transfer function $\tilde{A}(\omega)$ estimated based on the sound signal of the talker collected by the second sound collecting unit 20 and the first sound collecting unit 30 is represented by Expression (21) and Expression (23).

$$\tilde{A}(\omega) = \hat{A}(\omega)\left(\frac{A(\omega)}{A(\omega)}\right)^{D} \tag{21}$$

In Expression (21), $\tilde{A}(\omega)$ is expressed by Expression (22), and D is expressed by Expression (23).

$$\tilde{A}(\omega)=\lambda_{[T]}e^{-j\omega t[T]} \tag{22}$$

$$\tilde{A}(\omega)=DA(\omega)+(1-D)\cdot\hat{A}(\omega) \tag{23}$$

In Expression (23), the interpolated transfer function $\tilde{A}(\omega)$ is expressed by Expression (24).

$$\tilde{A}(\omega)=\lambda_{[F]}e^{-j\omega t[F]} \tag{24}$$

From Expression (21) and Expression (23), $\tilde{A}(\omega)$ is expressed by Expression (25).

$$\tilde{A}(\omega)=\lambda_{[T]}e^{-j\omega t[F]} \tag{25}$$

It is possible to adjust which one of Expression (21) and Expression (23) is weighted by the value of D.

The meaning of integrating a transfer function measured based on a sound signal output from a loudspeaker and a transfer function estimated based on a sound signal of a talker collected by the second sound collecting unit 20 and the first sound collecting unit 30 is to interpolate two transfer functions of the same direction and further interpolate a GMM described below.

As described above, by integrating a transfer function measured based on a sound signal output from a loudspeaker and a transfer function estimated based on a sound signal of a talker collected by the second sound collecting unit 20 and the first sound collecting unit 30, it is possible to estimate a transfer function in consideration of individual differences of drivers (for example, body height, direction of speech).

In addition, when switching between transfer functions of a plurality of talkers, the transfer function estimating unit 103 (talker identifying unit) may perform talker identification by using a sound signal collected by the first sound collecting unit 30 and switch to a transfer function corresponding to the identified talker. In this case, prior learning may be performed for talker identification, by using a GMM (Gaussian Mixture Model). Alternatively, the transfer function estimating unit 103 may generate an acoustic model used for identification from a sound signal used when a transfer function is estimated based on a sound signal collected by the second sound collecting unit 20 and the first sound collecting unit 30 and may cause the storage unit 109 to store the generated acoustic model. Then, the transfer function estimating unit 103 obtains the likelihood for each talker of the GMM by using a feature value extracted by the sound feature value extracting unit 106. Accordingly, by using a ratio of such calculated likelihoods, D in Expression (21) and Expression (23) may be determined. In other words, a transfer function of an acoustic model corresponding to the likelihood of the largest value is employed. In a case where a transfer function to be used is manually switched, D is 0 or 1.

Second Embodiment

The first embodiment is described using an example in which a sound signal is collected by using the second sound collecting unit 20 which is a close-talking microphone and the first sound collecting unit 30 which is a microphone array, and a transfer function is estimated based on the collected sound signal. The present embodiment is described using an example in which a sound signal is collected by using the first sound collecting unit 30 without using the second sound collecting unit 20, and a transfer function is estimated based on the collected sound signal.

Figure 15:
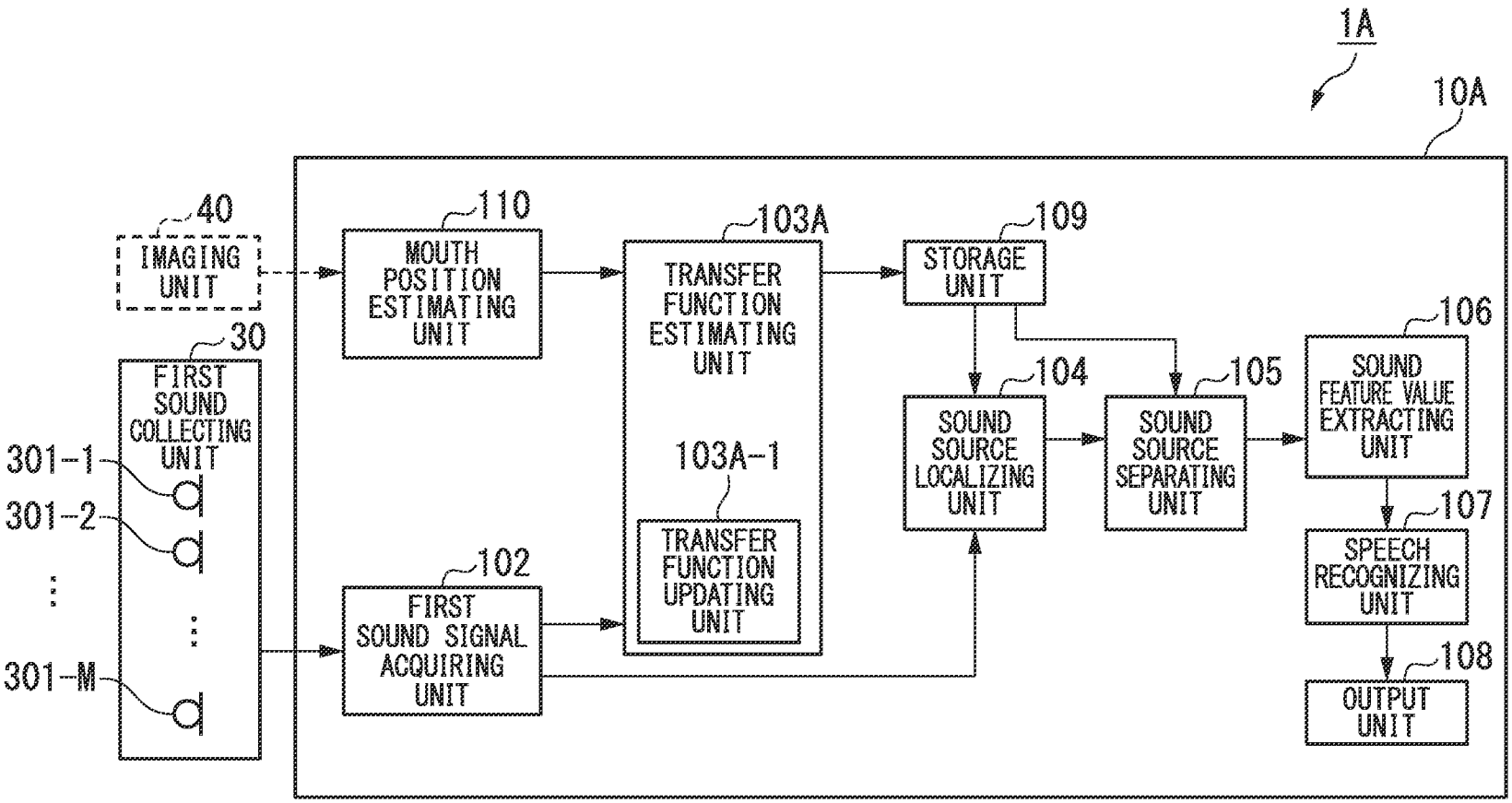
FIG. 15 is a block diagram showing a configuration of a sound processing apparatus according to a second embodiment.

FIG. 15 is a block diagram showing a configuration of a sound processing apparatus 10A according to the present embodiment. As shown in FIG. 15, a sound processing system 1A includes the sound processing apparatus 10A, a first sound collecting unit 30, and an imaging unit 40. Further, the sound processing apparatus 10A includes a first sound signal acquiring unit 102, a transfer function estimating unit 103A, a sound source localizing unit 104, a sound source separating unit 105, a sound feature value extracting unit 106, a speech recognizing unit 107, an output unit 108, a storage unit 109, and a mouth position estimating unit 110.

The transfer function estimating unit 103A includes a transfer function updating unit 103A-1. Further, the first sound collecting unit 30 is connected to the sound processing apparatus 10A. The same reference numeral is used for a functional unit having the same function as that of the sound processing apparatus 10 in FIG. 1 described in the first embodiment, and the description of the unit is omitted.

For example, the imaging unit 40 which captures an image including the mouth of a talker is connected to the mouth position estimating unit 110. The mouth position estimating unit 110 estimates a position of the mouth of a talker relative to the first sound collecting unit 30 based on the image captured by the imaging unit 40. The mouth position estimating unit 110, for example, estimates a position of the mouth of a talker relative to the first sound collecting unit 30 based on the size of an image of the mouth included in the captured image. The mouth position estimating unit 110 outputs information indicating the estimated mouth position to the transfer function estimating unit 103A.

When a position of a sound source is estimated by using a Kalman filter based on a sound signal only, the transfer function estimating unit 103A may include the mouth position estimating unit 110.

The transfer function estimating unit 103A estimates a transfer function by using the information indicating a mouth position output from the mouth position estimating unit 110 and the sound signal collected by the first sound collecting unit 30 and causes the storage unit 109 to store the estimated transfer function.

Figure 16:
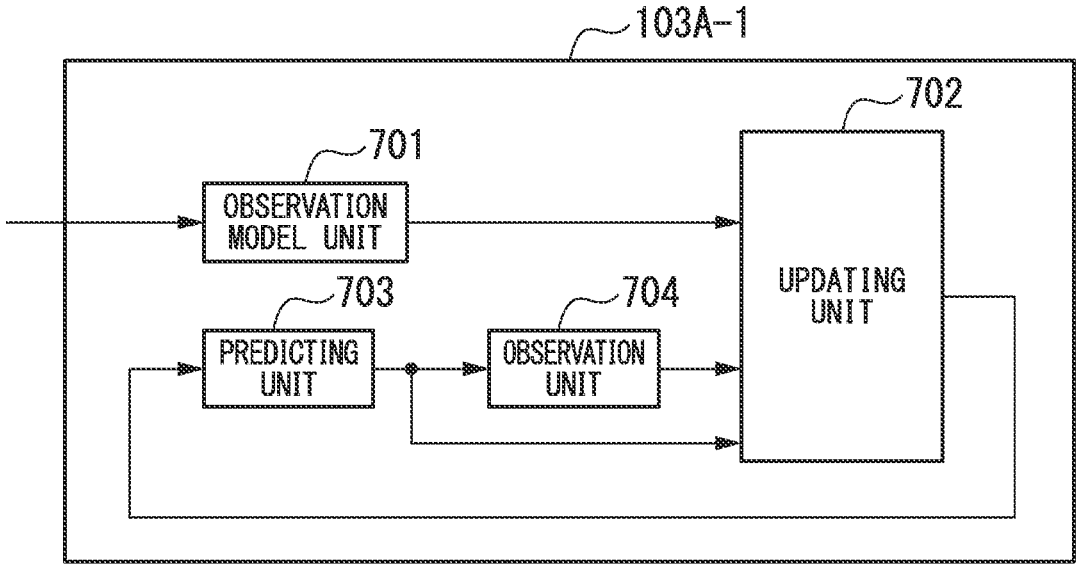
FIG. 16 is a block diagram showing a configuration of a transfer function updating unit according to the second embodiment.

FIG. 16 is a block diagram showing a configuration of a transfer function updating unit 103A-1 according to the present embodiment. As shown in FIG. 16, the transfer function updating unit 103A-1 includes an observation model unit 701, an updating unit 702, a predicting unit 703, and an observation unit 704.

A time difference $t_{[l]}$ with reference to a first microphone 301 described below and information indicating a position of a talker relative to the microphone 301 are input to the observation model unit 701. As described below, the observation model unit 701 uses an observation model to calculate an observation model $\zeta_{[l]}$ and outputs the calculated observation model $\zeta_{[l]}$ to the updating unit 702.

The updating unit 702 uses the observation model $\zeta_{[l]}$ input from the observation model unit 701, a variance $P^{\wedge}_{[l|l-1]}$ input from the predicting unit 703, and an observation value $h(\zeta^{\wedge}_{[l]})$ input from the observation unit 704 to update an observation model $\zeta^{\wedge}_{[l]}$ and a variance $P^{\wedge}_{[l]}$ and outputs the updated observation model $\zeta^{\wedge}_{[l]}$ and variance $P^{\wedge}_{[l]}$ to the predicting unit 703.

The predicting unit 703 predicts the next observation model $\zeta^{\wedge}_{[l|l-1]}$ and variance $P^{\wedge}_{[l|l-1]}$ by using the observation model $\zeta^{\wedge}_{[l]}$ and variance $P^{\wedge}_{[l]}$ input from the updating unit 702. The predicting unit 703 outputs the predicted observation model $\zeta^{\wedge}_{[l|l-1]}$ and variance $P^{\wedge}_{[l|l-1]}$ to the observation unit 704 and outputs the predicted variance $P^{\wedge}_{[l|l-1]}$ to the updating unit 702.

The observation unit 704 calculates the observation value $h(\zeta^{\wedge}_{[l]})$ by using the observation model $\zeta^{\wedge}_{[l|l-1]}$ and variance $P^{\wedge}_{[l|l-1]}$ input from the predicting unit 703 and outputs the calculated observation value $h(\zeta^{\wedge}_{[l]})$ to the updating unit 702.

A propagating wave model is described. In the description below, a signal in a frequency domain based on a sound signal uttered by a talker is referred to as $S(\omega)$, a signal in a frequency domain based on a sound signal collected by a microphone is referred to as $X_{[n]}(\omega)$, and a transfer function is referred to as $A(\xi_s, \xi_{m[n]}, \omega)$.

A signal $X_{[n]}(\omega)$ in a frequency domain in a case where a sound signal is one channel is expressed by Expression (26). Here, n represents the number of a microphone, $\xi_s$ represents a speech position, and $\xi_{m[n]}$ represents the position of an n-th microphone.

$$X_{[n]}(\omega)=A(\xi_s,\xi_{m[n]},\omega)S(\omega) \tag{26}$$

In Expression (26), $\xi_s$ is expressed by Expression (27), and $\xi_{m[n]}$ is represented by Expression (28).

$$\xi_s=[x_s,y_s]^T \tag{27}$$

$$\xi_{m[n]}=[x_{m[n]},y_{m[n]}]^T \tag{29}$$

A signal $X(\omega)$ in a frequency domain in a case where a sound signal is a multichannel is expressed by Expression (29).

$$X(\omega)=[X_{[1]}(\omega), \ldots ,X_{[N]}(\omega)]^T \tag{29}$$

In Expression (29), a transfer function $A(\xi_s, \xi_m, \omega)$ is expressed by Expression (30).

$$A(\xi_s,\xi_m,\omega)=[A(\xi_s,\xi_{m[1]},\omega), \ldots ,A(\xi_s,\xi_{m[N]},\omega)] \tag{30}$$

Figure 17:
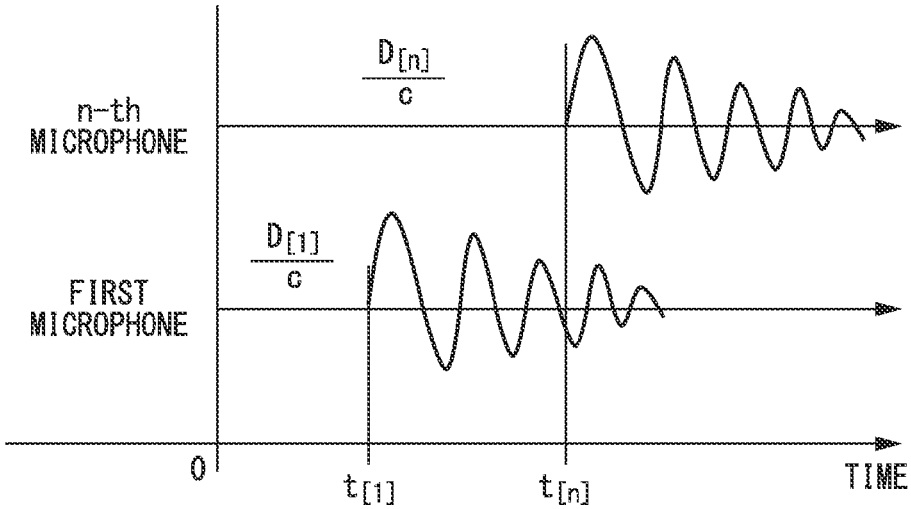
FIG. 17 is a diagram showing an example of a waveform of a sound signal collected by a first microphone at which a sound signal of a talker arrives earliest and a waveform of a sound signal collected by an n-th microphone.

FIG. 17 is a diagram showing an example of a waveform of a sound signal collected by a first microphone 301 at which a sound signal of a talker arrives earliest and a waveform of a sound signal collected by an n-th microphone 301. In FIG. 17, the horizontal axis represents time, and the vertical axis represents signal intensity. At time t=0, a talker utters. As described above, the position of the talker is $\xi_s$, and the position of the n-th microphone is $\xi_{m[n]}$. The distance between the talker and the n-th microphone is represented by $D_{[n]}$.

As shown in FIG. 17, at time $t_{[1]}$, a sound signal uttered by a talker begins in the first microphone 301, and at time $t_{[n]}$, a sound signal uttered by a talker begins in the n-th microphone 301. A delay time $t_{[n]}$ of the n-th microphone 301 relative to the first microphone 301 is expressed by Expression (31).

$$t_{[n]} = \frac{D_{[n]}}{c} \tag{31}$$

In Expression (31), c represents the speed of light. From Expression (27) and Expression (28), the distance $D_{[n]}$ is expressed by Expression (32).

$$D_{[n]}=\sqrt{(x_s-x_{m[n]})^2+(y_s-y_{m[n]})^2} \tag{32}$$

Next, a motion model is described.

The motion model (random walk model) of a talker is expressed by Expression (33).

$$\xi_{s[l+1]}=\xi_{s[l]}+W_{s[l]} \tag{33}$$

In Expression (33), $W_{s[l]}$ is expressed by Expression (34).

$$W_{s[l]}=[N(0,\sigma_x),N(0,\sigma_y)]^T \tag{34}$$

The motion model (random walk model) of a microphone is expressed by Expression (35).

$$\xi_{m[l+1]}=\xi_{m[l]}+W_{m[l]} \tag{35}$$

In Expression (35), $W_{m[1]}$ is expressed by Expression (36), and $W_{m[n][l]}$ is expressed by Expression (37).

$$W_{m[l]}=[W_{m[1][l]}, \ldots ,W_{m[N][l]}]^T \in \Re^{2N\times 1} \tag{36}$$

$$W_{m[n][l]}=[N(0,\sigma_m),N(0,\sigma_m)]^T \tag{37}$$

In Expression (36), R represents a covariance matrix.

Next, an observation model is described. The observation model described below is stored in the observation model unit 701.

When observing a time difference with reference to the first microphone 301, the time difference is expressed by Expression (38).

$$t_{[n][l]} - t_{[1][l]} = \frac{D_{[n][l]} - D_{[1][l]}}{c} \tag{38}$$

The observation model is expressed by Expression (39).

$$\zeta_{[l]} = \begin{bmatrix} \frac{D_{[2][l]} - D_{[1][l]}}{c} \\ \vdots \\ \frac{D_{[N][l]} - D_{[1][l]}}{c} \end{bmatrix} + \delta_{[l]} \tag{39}$$

The observation model unit 701 calculates an observation model $\zeta_{[l]}$ by using Expression (38) and Expression (39) and outputs the calculated observation model $\zeta_{[l]}$ to the updating unit 702.

Next, a prediction step performed by the predicting unit 703 is described.

The predicting unit 703 performs update of an average by using Expression (40).

$$\left.\begin{aligned} \hat{\xi}_{[l-1]} &= [\hat{\xi}_{s[l-1]}, \hat{\xi}_{m[l-1]}^{T}] \\ \xi_{s[l|l-1]} &= \xi_{s[l-1]} \\ \xi_{m[l|l-1]} &= \xi_{m[l-1]} \end{aligned}\right\} \tag{40}$$

The predicting unit 703 performs update of a variance P by using Expression (41).

$$\left.\begin{aligned} \hat{P}_{[l|l-1]} &= \hat{P}_{[l-1]} + F^{T}RF \\ F &= [I^{2\times 2}, O^{2\times 2N}] \\ R &= diag(\sigma_x^2, \sigma_y^2) \end{aligned}\right\} \tag{41}$$

In Expression (41), I represents a unit matrix, and diag( ) represents a diagonal matrix. P represents a variance, F represents a linear model relating to the time transition of a system, and R represents a covariance matrix. The predicting unit 703 updates an observation model $\hat{\zeta}_{[l|l-1]}$ by an observation model $\hat{\zeta}_{[l-1]}$ input from the updating unit 702 and outputs the updated observation model $\hat{\zeta}_{[l|l-1]}$ to the observation unit 704. Further, the predicting unit 703 updates a variance $\hat{P}_{[l|l-1]}$ by a variance $\hat{P}_{[l-1]}$ input from the updating unit 702 and outputs the updated variance $\hat{P}_{[l|l-1]}$ to the observation unit 704 and the updating unit 702.

Next, an observation step performed by the observation unit 704 is described.

The observation unit 704 observes the observation model $\hat{\zeta}_{[l|l-1]}$ input from the predicting unit 703, calculates an observation value $h(\hat{\zeta}_{[l]})$ using Expression (42), and outputs the calculated observation value $h(\hat{\zeta}_{[l]})$ to the updating unit 702.

$$h(\xi_{[l]}) = \begin{bmatrix} \frac{\hat{D}_{[2][l]} - \hat{D}_{[1][l]}}{c} \\ \vdots \\ \frac{\hat{D}_{[N][l]} - \hat{D}_{[1][l]}}{c} \end{bmatrix} \tag{42}$$

Next, an update step performed by the updating unit 702 is described.

The updating unit 702 updates a Karman gain K using Expression (43).

$$K_{[l]} = P_{[l|l-1]}H_{[l]}^{T}(H_{[l]}P_{[l|l-1]}H_{[l]}^{T} + Q_{[l]})^{-1} \tag{43}$$

In Expression (43), H represents an observation model which plays a role of linearly mapping an observation space on a state space, and Q represents a covariance matrix.

The updating unit 702 updates the observation model $\hat{\zeta}_{[l]}$ using Expression (44).

$$\hat{\xi}_{[l]} = \hat{\xi}_{[l|l-1]} + K_{[l]}(\xi_{[l]} - h(\hat{\xi}_{[l]})) \tag{44}$$

In Expression (43), $P_{[l]}$ is expressed by Expression (45), $H_{[l]}$ is expressed by Expression (46), and $Q_{[l]}$ is expressed by Expression (47).

$$P_{[l]} = (I - K_{[l]}H_{[l]})P_{[l|l-1]} \tag{45}$$

$$H_{[l]} = \frac{\partial h(\xi_{[l]})}{\partial \xi_{[l]}}\bigg|_{\xi=\hat{\xi}_{[l|k-1]}} \tag{46}$$

$$Q_{[l]} = diag(\sigma_r^2, \ldots, \sigma_r^2) \in \mathcal{R}^{N-1\times N-1} \tag{47}$$

In Expression (47), $\sigma_r$ represents a variance with respect to an observation.

The updating unit 702 updates the observation model $\hat{\zeta}_{[l]}$ and variance $\hat{P}_{[l]}$ by using the observation model $\zeta_{[l]}$ input from the observation model unit 701, the observation value $h(\hat{\zeta}_{[l]})$ input from the observation unit 704, the variance $\hat{P}_{[l|l-1]}$ input from the predicting unit 703, and Expression (44) to Expression (47) described above and outputs the updated observation model $\hat{\zeta}_{[l]}$ and variance $\hat{P}_{[l]}$ to the predicting unit 703.

The transfer function updating unit 103A-1 performs the update described above until an estimation error becomes minimum and estimates a transfer function $A(\hat{\xi}_{s[l]}, \hat{\xi}_{m[l]}, \omega)$.

As described above, the sound processing apparatus 10A of the present embodiment includes: the first sound collecting unit 30 that is placed in a sound field and collects a sound signal which is speech of a talker; a talker position estimating unit (mouth position estimating unit 110) that estimates a talker position which is a position of a talker relative to the first sound collecting unit 30; the transfer function estimating unit 103 that estimates a transfer function from a sound signal collected by the first sound collecting unit 30 when a talker is at a predetermined position in the sound field and the estimated talker position; and a sound signal processing unit (sound source localizing unit 104, sound source separating unit 105, sound feature value extracting unit 106, speech recognizing unit 107) that performs a process of the sound signal by use of the transfer function estimated by the transfer function estimating unit 103.

By this configuration, according to the present embodiment, it is possible to estimate a transfer function without using the second sound collecting unit 20, by using the first sound collecting unit 30 only.

When a sound signal is collected by using the second sound collecting unit 20 and the first sound collecting unit 30, and a transfer function is estimated based on the collected sound signal for the first time only, a sound signal may be collected by using the first sound collecting unit 30 at and after the second time. The transfer function estimating unit 103 may use a sound signal collected by the first sound collecting unit 30 as an observation value and, by sequentially updating a Karman filter, adjust the transfer function estimated for the first time. Thus, the transfer function can be adjusted.

Since such sequential update is performed, the transfer function estimating unit 103 may estimate a transfer function by using a method in a time domain of the methods described above.

The first embodiment is described using an example in which, in a case where there are a plurality of drivers, a sound signal is collected by using the second sound collecting unit 20 and the first sound collecting unit 30, and a transfer function is estimated based on the collected sound signal; however, the embodiment is not limited thereto.

For example, only speech of a first driver is collected by using the second sound collecting unit 20 and the first sound collecting unit 30, and a transfer function is estimated based on the collected sound signal. Speech of another driver is collected by using the first sound collecting unit 30. Then, the transfer function estimating unit 103 or 103A may use the collected sound signal which is speech of a driver as an observation value and, by sequentially updating a Karman filter, adjust the transfer function of the first driver. Thus, the transfer function of the first driver can be adjusted. The transfer function estimating unit 103 or 103A may associate the transfer function adjusted in this way with the driver as a talker and cause the storage unit 109 to store the associated transfer function.

Similarly, since sequential update is performed, the transfer function estimating unit 103 or 103A may estimate a transfer function by using a method in a time domain of the methods described above.

Also in the sound processing apparatus 10 of the first embodiment, the talker identification described above may be performed. The transfer function estimating unit 103 or 103A determines whether or not a transfer function corresponding to an identified talker is already stored in the storage unit 109. When a transfer function corresponding to the talker is already stored in the storage unit 109, the transfer function estimating unit 103 or 103A reads out the transfer function corresponding to the talker from the storage unit 109 and uses the transfer function which is read out.

On the other hand, when a transfer function corresponding to the talker is not already stored in the storage unit 109, the transfer function estimating unit 103 or 103A may perform notification which prompts a talker to talk. For example, the notification may be performed by use of a sound signal from a loudspeaker (not shown) connected to the sound processing apparatus 10 or the like, or may be performed by use of an image or character information from a display unit (not shown) connected to the sound processing apparatus 10 (or 10A) or the like.

Figure 18:
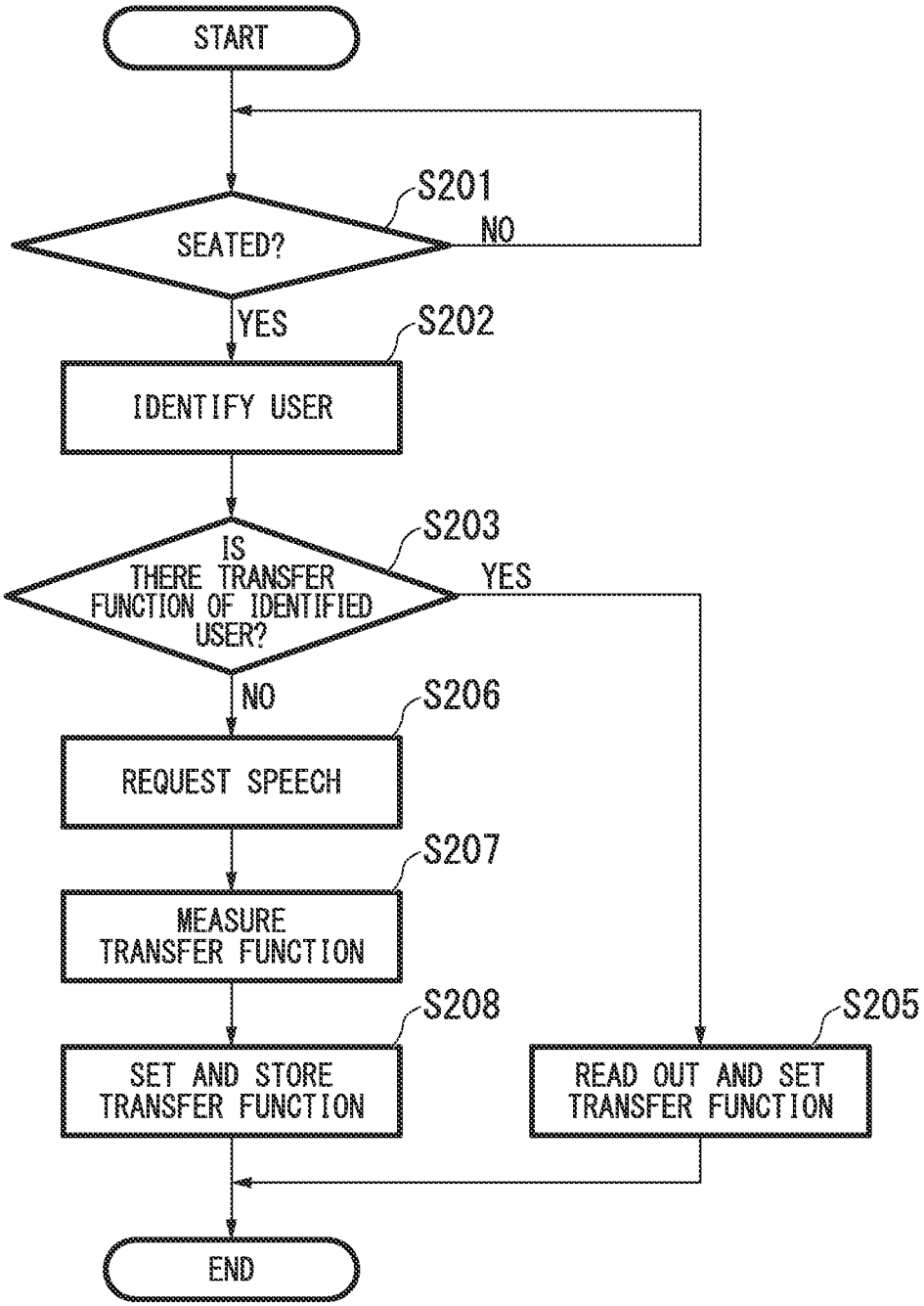
FIG. 18 is a flowchart of a process in which a transfer function is set according to the second embodiment.
Figure 19:
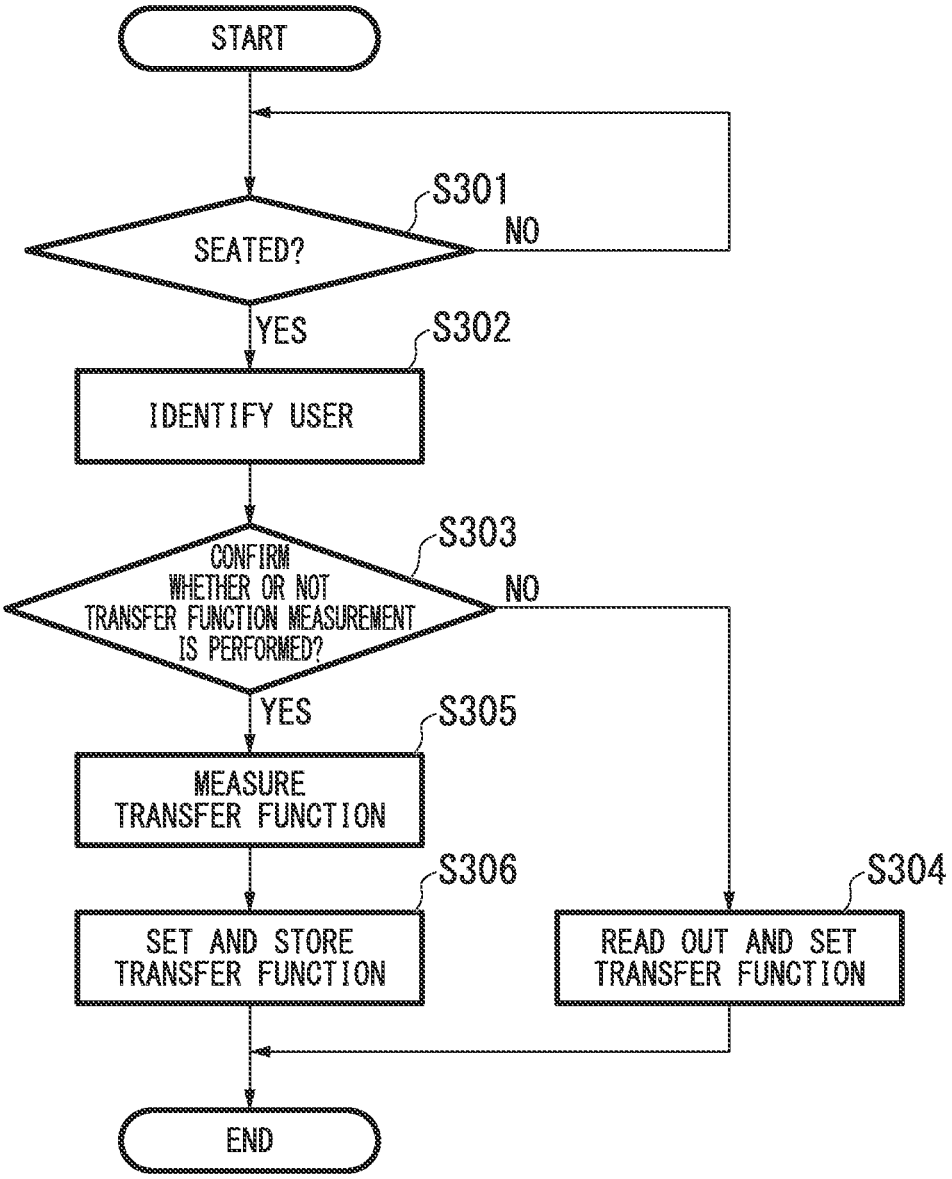
FIG. 19 is a flowchart of a process in which a transfer function is set according to the second embodiment.
Figure 20:
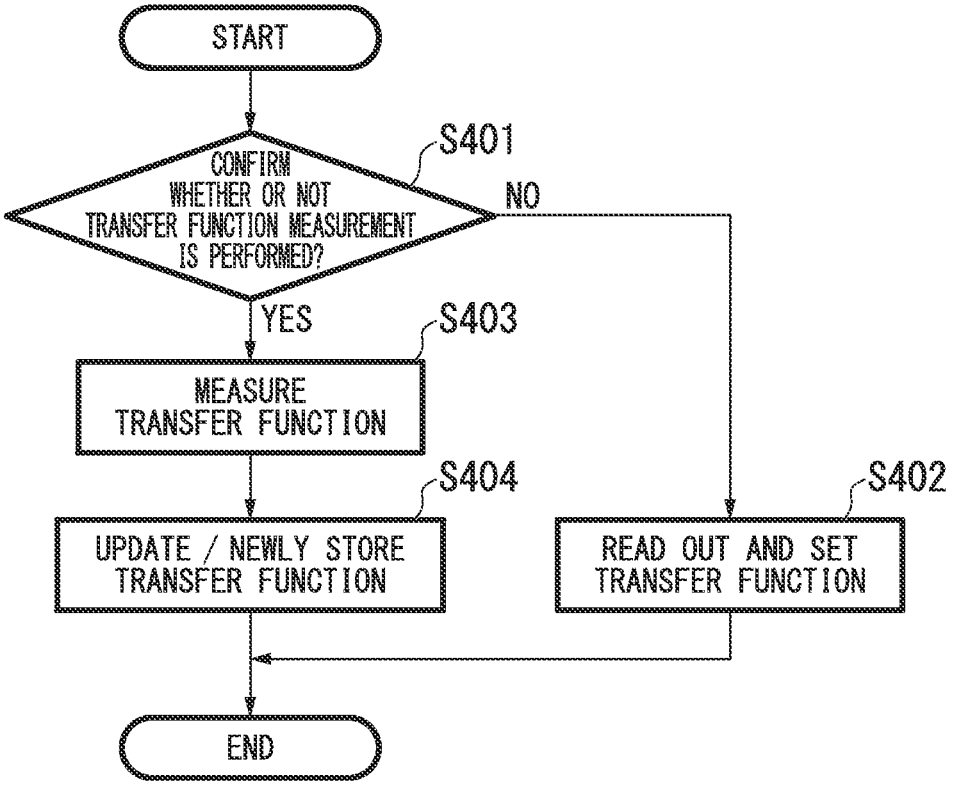
FIG. 20 is a flowchart of a process in which a transfer function is set according to the second embodiment.

Hereinafter, an example of a process sequence in which identification of a talker is performed and a transfer function is set is described by using FIG. 18 to FIG. 20. Each of FIG. 18 to FIG. 20 is a flowchart of a process in which a transfer function is set according to the present embodiment. In the following description, an example in which the sound processing apparatus 10A having a configuration of FIG. 15 performs a process of setting a transfer function is described; however, the sound processing apparatus 10 having a configuration of FIG. 1 may perform the process of setting a transfer function.

First, an example of a process of setting a transfer function is described by using FIG. 18.

(Step S201) When the imaging unit 40 is connected to the sound processing apparatus 10A, the transfer function estimating unit 103A determines whether or not an occupant is seated on a seat, based on an image captured by an imaging apparatus. The transfer function estimating unit 103A may determine whether or not an occupant is seated on the seat, based on a result of detection by an occupant detection sensor (not shown) provided on the seat. The routine proceeds to Step S202 when the transfer function estimating unit 103A determines that an occupant is seated on the seat (Step S201; YES). The routine repeats Step S201 when the transfer function estimating unit 103A determines that an occupant is not seated on the seat (Step S201; NO).

(Step S202) The transfer function estimating unit 103A automatically performs identification of a user seated on a seat, for example, based on a sound signal acquired by the first sound signal acquiring unit 102. The transfer function estimating unit 103A may perform identification of a user by using an image captured by the imaging unit 40. Alternatively, a user may operate an operation unit (not shown) connected to the sound processing apparatus 10A, and thereby information relating to a user may be selected or input.

(Step S203) The transfer function estimating unit 103A determines whether or not a transfer function corresponding to the user identified in Step S202 is stored in the storage unit 109. The routine proceeds to Step S206 when the transfer function estimating unit 103A determines that the transfer function corresponding to the identified user is not stored in the storage unit 109 (Step S203; NO). The routine proceeds to Step S205 when the transfer function estimating unit 103A determines that the transfer function corresponding to the identified user is stored in the storage unit 109 (Step S203; YES).

(Step S205) The transfer function estimating unit 103A reads out a transfer function stored in the storage unit 109 and sets such that the transfer function which is read out is used for speech of the user. After the setting, the transfer function estimating unit 103A terminates the process.

(Step S206) The transfer function estimating unit 103A, for example, outputs a speech signal for requesting speech, which is preliminarily stored in the storage unit 109, to the output unit 108 to thereby request speech of the user.

(Step S207) The transfer function estimating unit 103A measures a transfer function based on a sound signal acquired by the first sound signal acquiring unit 102.

(Step S208) The transfer function estimating unit 103A stores the measured transfer function in the storage unit 109.

Next, another example of a process sequence of setting a transfer function is described by using FIG. 19.

(Step S301 to S302) The transfer function estimating unit 103A performs a process of Step S301 similarly to Step S201 (FIG. 18) and performs a process of Step S302 similarly to Step S202 (FIG. 18). After finishing Step S301, the transfer function estimating unit 103A may advance the process to Step S303 without performing Step S302.

(Step S303) The transfer function estimating unit 103A determines whether or not measurement of a transfer function is performed based on a result of operation of an operation unit (not shown) by the user. The routine proceeds to Step S304 when the transfer function estimating unit 103A determines that measurement of a transfer function is not performed (Step S303: NO). The routine proceeds to Step S305 when the transfer function estimating unit 103A determines that measurement of a transfer function is performed (Step S303: YES).

(Step S304 to S306) The transfer function estimating unit 103A performs a process of Step S304 similarly to Step S205, performs a process of Step S305 similarly to Step S207, and performs a process of Step S306 similarly to Step S208.

In Step S303, for example, when the user selects information indicating that a speech recognition function is not used, the transfer function estimating unit 103A may determine that measurement of a transfer function is not performed. Alternatively, when the user selects information indicating that a speech recognition function is used, the transfer function estimating unit 103A may determine that measurement of a transfer function is performed.

Next, still another example of a process sequence of setting a transfer function is described by using FIG. 20.

(Step S401 to S403) The transfer function estimating unit 103A performs a process of Step S401 similarly to Step S303 (FIG. 19), performs a process of Step S402 similarly to Step S304 (FIG. 19), and performs a process of Step S403 similarly to Step S305 (FIG. 19). For example, the process of Step S401 is started in response to operation of an operation unit by the user. After finishing Step S403, the transfer function estimating unit 103A advances the process to Step S404.

(Step S404) The transfer function estimating unit 103A updates the measured transfer function and stores the updated transfer function in the storage unit 109. Alternatively, the transfer function estimating unit 103A newly stores the measured transfer function in the storage unit 109.

In the example shown in FIG. 20, even when the sound processing apparatus 10A performs a recognition process by using a transfer function which is already stored in the storage unit 109, in a case where the user feels that the recognition rate is low, the user may operate the operation unit such that measurement of a transfer function is performed again. The sound processing apparatus 10A may determine that measurement of a transfer function is performed in Step S401 in response to this operation.

The process sequences shown in FIG. 18 to FIG. 20 are just examples; and the embodiment is not limited thereto. For example, a plurality of acoustic models or language models may be associated with information indicating a user and stored in the storage unit 109. Based on a result of identification of a user, the transfer function estimating unit 103A may read out from the storage unit 109 and use an acoustic model or a language model corresponding to the user.

In this way, by using a plurality of acoustic models or language models, for example, even in such a case that a first user is a man who speaks Japanese and a second user is a woman who speaks English, the sound processing apparatus 10A of the present embodiment can measure a transfer function in a space such as in a vehicle by using an acoustic model or a language model for each user. As a result, according to the present embodiment, it is possible to improve a speech recognition rate in a space such as in a vehicle.

Third Embodiment

The first embodiment is described using an example in which the transfer function estimating unit 103 estimates a transfer function based on a sound signal collected by the second sound collecting unit 20 which is a close-talking microphone and the first sound collecting unit 30 which is a microphone array.

The present embodiment is described using an example in which a transfer function is estimated by using only the microphone array without using the close-talking microphone.

Figure 21:
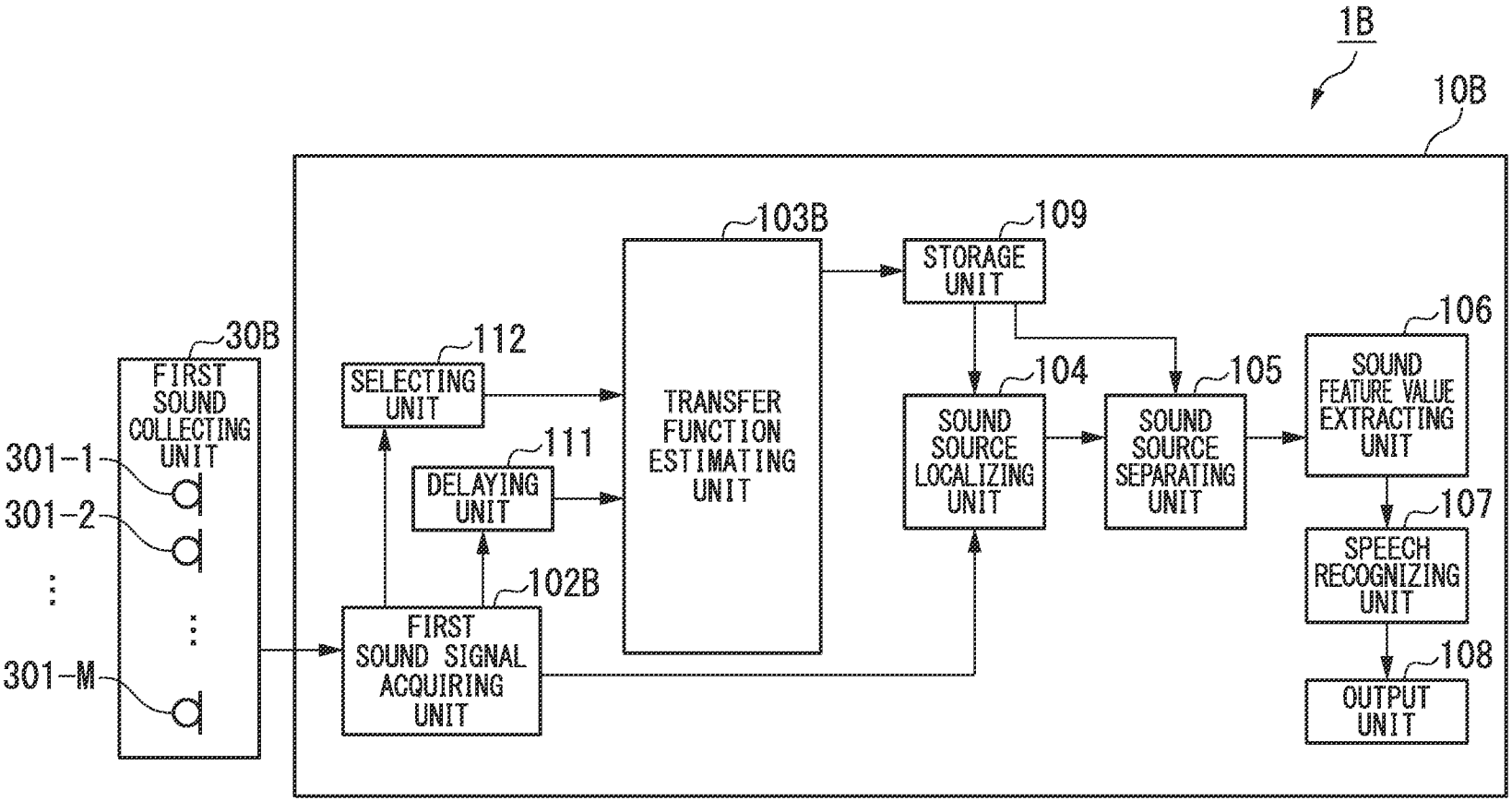
FIG. 21 is a block diagram showing a configuration of a sound processing apparatus according to a third embodiment.

FIG. 21 is a block diagram showing a configuration of a sound processing apparatus 10B according to the present embodiment. As shown in FIG. 21, a sound processing system 1B includes the sound processing apparatus 10B and a first sound collecting unit 30B. Further, the sound processing apparatus 10B includes a first sound signal acquiring unit 102B, a transfer function estimating unit 103B, a sound source localizing unit 104, a sound source separating unit 105, a sound feature value extracting unit 106, a speech recognizing unit 107, an output unit 108, a storage unit 109, a delaying unit 111, and a selecting unit 112. Further, the first sound collecting unit 30B is connected to the sound processing apparatus 10B. The same reference numeral is used for a functional unit having the same function as that of the sound processing apparatus 10. The first sound signal acquiring unit 102B corresponds to the first sound signal acquiring unit 102 (FIG. 1). The first sound collecting unit 30B corresponds to the first sound collecting unit 30 (FIG. 1).

The first sound signal acquiring unit 102B acquires M sound signals, one of the M sound signals being collected by each of the M microphones 301 of the first sound collecting unit 30B. The first sound signal acquiring unit 102B outputs the acquired M sound signals to the transfer function estimating unit 103B, the delaying unit 111, and the selecting unit 112.

The delaying unit 111 applies a delay operation (time delay, time shift) by a predetermined time on the M sound signals input from the first sound signal acquiring unit 102B. Here, the predetermined time is, as described below, a time which makes an impulse response of a sound signal closer to the sound source than a microphone 301 corresponding to a representative channel selected by the selecting unit 112 be at a positive time by calculation. The delaying unit 111 applies Fourier transform in a time domain on the time-delayed M sound signals for each frame and thereby generates an input signal in a frequency domain. The delaying unit 111 outputs Fourier-transformed M sound signals to the transfer function estimating unit 103B. The sound signal input to the sound source localizing unit 104 may be a signal which is delayed by the delaying unit 111 and on which the Fourier transform is not applied yet.

The selecting unit 112 selects one sound signal of the M sound signals input from the first sound signal acquiring unit 102B. The selected sound signal may be arbitrary, or may be one corresponding a predetermined microphone 301. The selecting unit 112 outputs information indicating the selection result, to the transfer function estimating unit 103B. The selection of a sound signal may be performed by the transfer function estimating unit 103B.

The transfer function estimating unit 103B estimates a transfer function as described below by using the information indicating the selection result input from the selecting unit 112 and the sound signal input from the delaying unit 111 and outputs the estimated transfer function to the sound source localizing unit 104. Further, the transfer function estimating unit 103B causes the storage unit 109 to store the estimated transfer function. The transfer function estimating unit 103B may associate a talker and a transfer function and may cause the storage unit 109 to store the transfer function associated with the talker, for example, in such a case that there are a plurality of drivers who use a vehicle. In this case, for example, in response to information input by a driver via an operation unit (not shown), the transfer function estimating unit 103B reads out and uses a transfer function corresponding to the driver, of the transfer functions stored in the storage unit 109.

Figure 22:
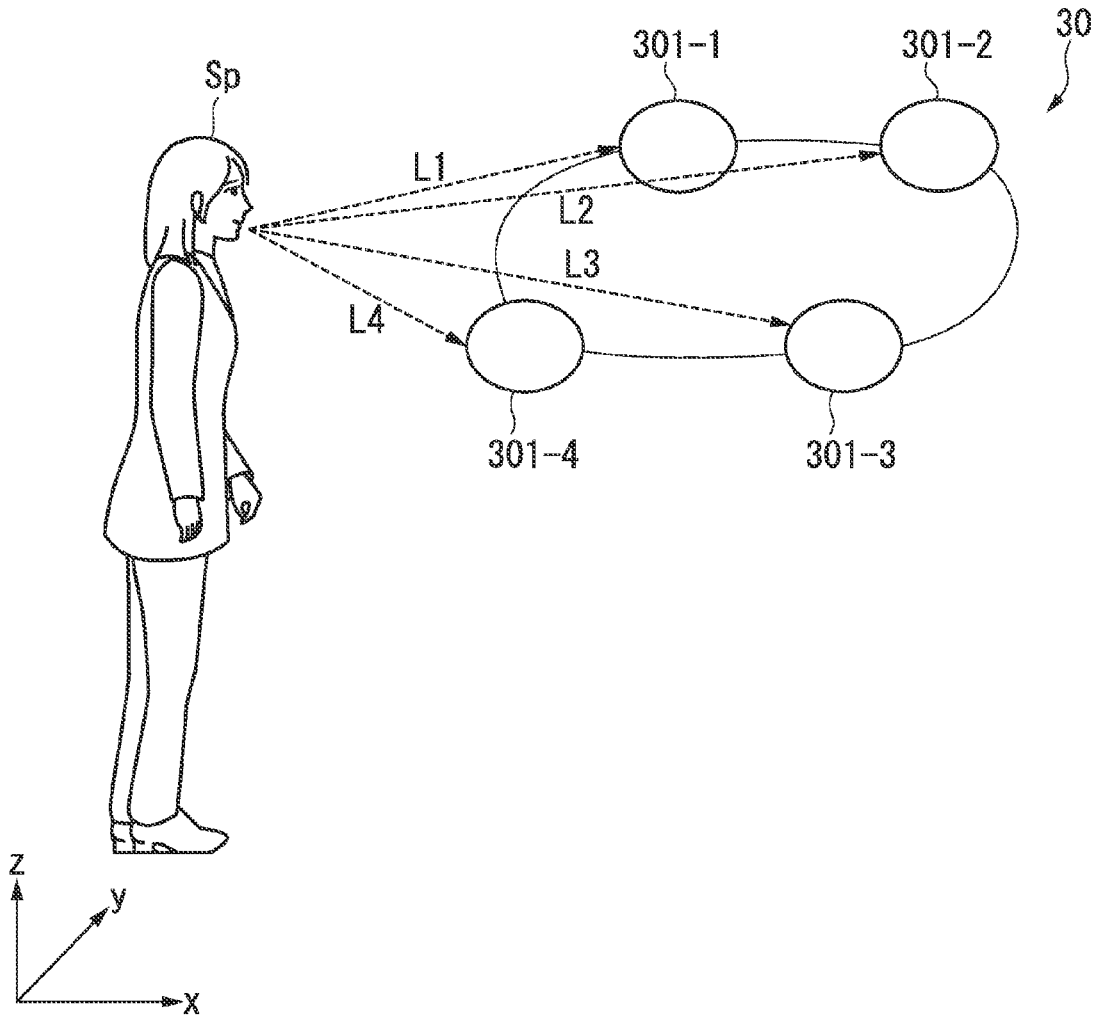
FIG. 22 is a diagram showing a position relation between a talker and a microphone of a sound collecting unit according to the third embodiment.

FIG. 22 is a diagram showing a position relation between a talker Sp and the microphone 301 of the first sound collecting unit 30B according to the present embodiment. In FIG. 22, the surface of a floor on which the talker Sp stands is an xy plane, the front direction of the talker Sp is an x-axis direction, the left-hand direction of the talker Sp is a y-axis direction, and the height direction is a z-axis direction.

In the example shown in FIG. 22, the first sound collecting unit 30B includes four microphones 301-1 to 301-4. The four microphones 301-1 to 301-4 configure a microphone array. The microphone array is configured, for example, on a plane parallel to the xy plane.

As shown in FIG. 22, the distance between the mouth of the talker Sp and one of the microphones 301-1 to 301-4 is each of L1, L2, L3, and L4. In the example shown in FIG. 22, a distance L4 between the microphone 301-4 and the mouth of the talker Sp is the shortest. That is, the microphone 301-4 is the closest to the mouth of the talker Sp. A distance L1 between the microphone 301-1 and the mouth of the talker Sp is longer than the distance L4 and is shorter than a distance L3. The distance L3 between the microphone 301-3 and the mouth of the talker Sp is longer than the distance L1 and is shorter than a distance L2. The distance L2 between the microphone 301-2 and the mouth of the talker Sp is the longest. That is, the microphone 301-2 is the farthest from the mouth of the talker Sp. In this way, the distance between the mouth of the talker Sp and the microphone array provided in the vehicle as described in FIG. 2 of the first embodiment is different for each of the microphones 301.

In the following description, a first channel sound signal that arrives at the microphone 301-1 is referred to as 1ch, a second channel sound signal that arrives at the microphone 301-2 is referred to as 2ch, a third channel sound signal that arrives at the microphone 301-3 is referred to as 3ch, and a fourth channel sound signal that arrives at the microphone 301-4 is referred to as 4ch.

Figure 23:
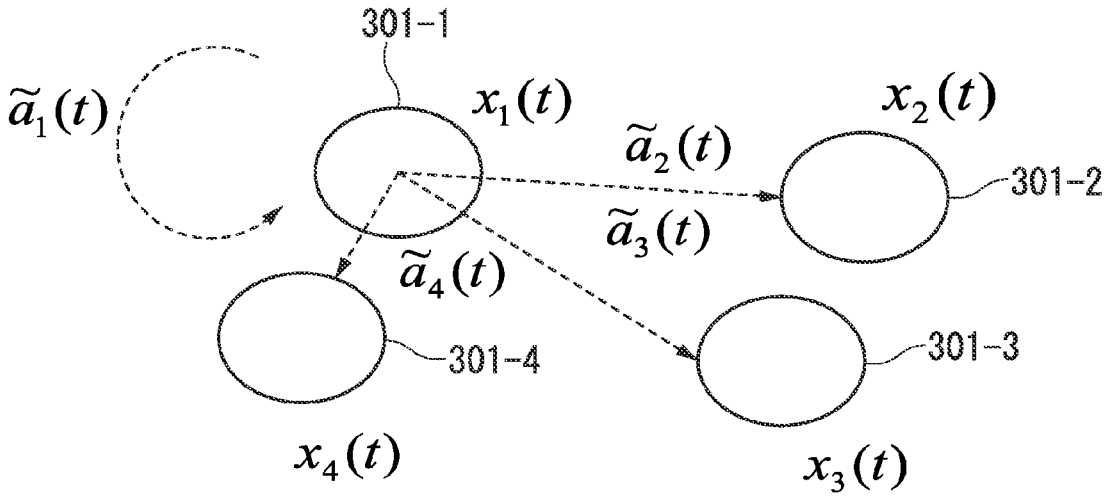
FIG. 23 is a diagram showing a signal in a microphone array and a transfer function according to the third embodiment.

FIG. 23 is a diagram showing a signal in the microphone array and a transfer function according to the present embodiment.

In FIG. 23, a sound signal that arrives at the microphone 301-1 is a representative channel.

One of the signals $x_1(t)$ to $x_4(t)$ is a time domain signal of the sound signal collected by each of the microphones 301-1 to 301-4. Further, $\tilde{a}_1(t)$ is a transfer function estimated between the microphone 301-1 and the microphone 301-1, $\tilde{a}_2(t)$ is a transfer function estimated between the microphone 301-1 and the microphone 301-2, $\tilde{a}_3(t)$ is a transfer function estimated between the microphone 301-1 and the microphone 301-3, and $\tilde{a}_4(t)$ is a transfer function estimated between the microphone 301-1 and the microphone 301-4.

Next, a case where the number of microphones 301 is M is described.

One of $a_1(t)$ to $a_4(t)$ is a transfer function of each of the microphones 301-1 to 301-4. First, it is assumed that the sound signal collected by the microphone 301-1 is a representative channel. When the order is N, time domain signals $x_1[N]$ to $x_M[N]$ are expressed by Expression (48).

$$\begin{bmatrix} x_{1[N]} \\ \vdots \\ x_{M[N]} \end{bmatrix} = \begin{bmatrix} a_{1[N]} & \cdots & a_{1[1]} \\ \vdots & \ddots & \vdots \\ a_{M[N]} & \cdots & a_{M[1]} \end{bmatrix} \begin{bmatrix} x_{1[1]} \\ \vdots \\ x_{1[N]} \end{bmatrix} \tag{48}$$

Figure 24:
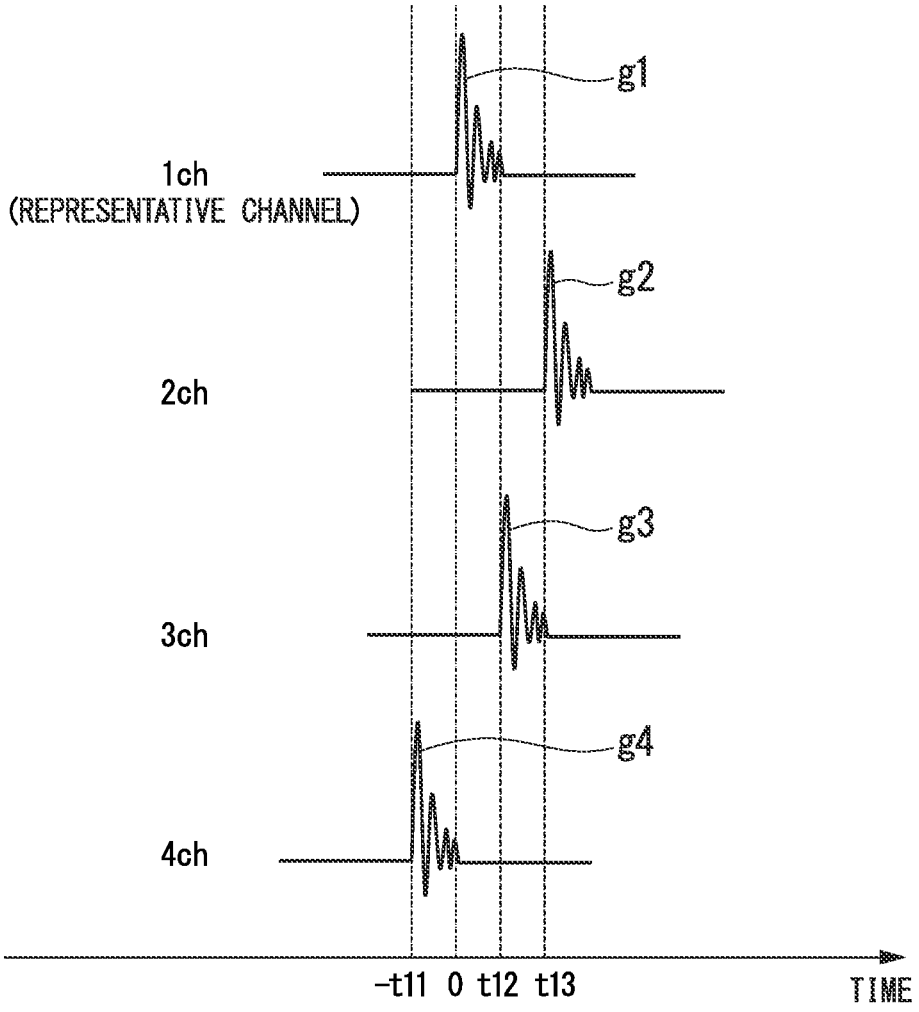
FIG. 24 is a diagram showing a timing of a transfer function of each channel when a start time of an impulse of a transfer function in a representative channel is 0.

FIG. 24 is a diagram showing a timing of a transfer function of each channel when a start time of an impulse of a transfer function in a representative channel is 0.

In FIG. 24, the horizontal axis represents time, and the vertical axis represents signal intensity. FIG. 24 is an example of direct waves collected by the four microphones 301-1 to 301-4, and it is assumed that there is the same relation as that described in FIG. 22 between the distances L1 to L4, one of which is the distance between the mouth of the talker Sp and each of the microphones 301-1 to 301-4. A waveform g1 represents the waveform of the impulse response of a 1ch transfer function, a waveform g2 represents the waveform of the impulse response of a 2ch transfer function, a waveform g3 represents the waveform of the impulse response of a 3ch transfer function, and a waveform g4 represents the waveform of the impulse response of a 4ch transfer function.

Here, it is assumed that the 1ch is a representative channel, and it is assumed that as the waveform g1, the start time of the impulse response of the 1ch transfer function is 0. As the waveform g2, a time t13 is the start time of the impulse response of the 2ch transfer function, and as the waveform g3, a time t12 is the start time of the impulse response of the 3ch transfer function. As the waveform g4, a time −t11 is the start time of the impulse response of the 4ch transfer function.

That is, in a case where an arbitrary microphone 301 is selected of the microphones 301, when there is a microphone 301 which is closer to the mouth of the talker Sp than the selected microphone 301, a direct wave arrives at a negative time of the impulse response of the transfer function with respect to the microphone 301.

Therefore, in the present embodiment, even in a case where an arbitrary microphone 301 is selected of the microphones 301 by the selecting unit 112, the delaying unit 111 performs a delay operation by a predetermined time T such that the start time of a channel which is closer to the sound source than the representative channel is not at a negative time, and estimation of a transfer function is performed.

Figure 25:
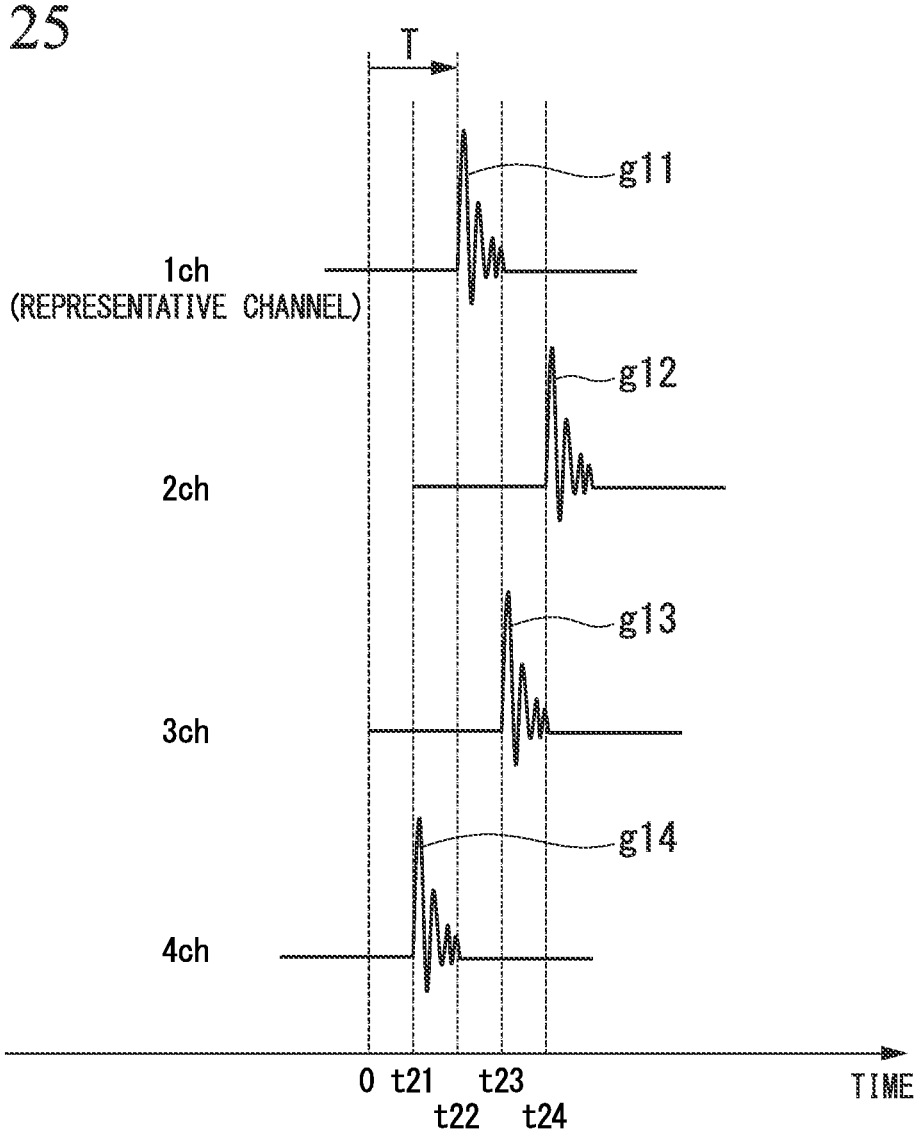
FIG. 25 is a diagram showing a timing of a transfer function of each channel when the start time of each of all acquired sound signals is delayed by a time T.

FIG. 25 is a diagram showing a timing of a transfer function of each channel when the start time of each of all acquired sound signals is delayed by a time T. In FIG. 25, the horizontal axis represents time, and the vertical axis represents signal intensity.

As shown in FIG. 25, the start time of the impulse response of the 1ch which is a representative channel is shifted from time 0 by T. As a result, as a waveform g11, a time 22 is the start time of the impulse response of the 1ch transfer function, and as a waveform g12, a time t24 is the start time of the impulse response of the 2ch transfer function. As a waveform g13, a time t23 is the start time of the impulse response of the 3ch transfer function, and as a waveform g14, a time t21 is the start time of the impulse response of the 4ch transfer function.

That is, even in a case where an arbitrary microphone 301 is selected of the microphones 301, and there is a microphone 301 which is closer to the mouth of the talker Sp than the selected microphone 301, a direct wave arrives at a positive time of the impulse response of the transfer function with respect to all of the microphones 301.

When the number of the microphones 301 is M, and the order is N, time domain signals $x_1[N]$ to $x_M[N]$ are ones delayed from Expression (48) by the time T and therefore is expressed by Expression (49).

$$\begin{bmatrix} x_{1[N]} \\ \vdots \\ x_{M[N]} \end{bmatrix} = \begin{bmatrix} a_{1[N]} & \cdots & a_{1[1]} \\ \vdots & \ddots & \vdots \\ a_{M[N]} & \cdots & a_{M[1]} \end{bmatrix} \begin{bmatrix} x_{1[1-T]} \\ \vdots \\ x_{1[N-T]} \end{bmatrix} \tag{49}$$

In Expression (49), the left-hand term is defined as $x_{[N]}$, the first right-hand term is defined as a(t), and the second right-hand term is defined as $\mathbf{x1}_{[1-T:N-T]}$.

When Fourier transform is applied on Expression (49), Expression (49) is converted into Expression (50).

$$X_{[N]}=A(\omega)X_1(\omega) \tag{50}$$

In Expression (50), ω is a frequency in a frequency domain, and $X_{1[N]}$ is a complex scalar.

From Expression (50), when assuming first to N-th samples as one frame, an observation value $X_{[N]}{}^T$ of one frame in a frequency domain is expressed by Expression (51).

$$X_{[N]}{}^T=X_{1[N]}A^T(\omega) \tag{51}$$

The transfer function estimating unit 103B estimates a transfer function by the same process as that of the TD method, FD method, FDA method, FDN method, FDP method, FDC method, and/or FDS method described in the first embodiment using Expression (51) as the observation value of one frame.

Next, test results in a case where the sound processing apparatus 10B of the present embodiment is used are described.

First, the test condition is described. A sound source used for the test was a loudspeaker capable of changing the angle by each 30 degrees. Speech uttered by a person was recorded, and the recorded sound signal was output from the loudspeaker. Collection of the sound signal was performed by using eight microphones 301.

In the sound processing apparatus 10B, the order N is 4096, and the usage sample number is 16384×1. The transfer function estimating unit 103B estimated a transfer function by using the FD method. In the estimation condition, the usage order T is 4096, the frame length N is 1638, the shift length is 10, the used window function is a Hamming function, and the delay amount T is 128. The test was performed by changing the angle of the loudspeaker to be −60 degrees, −30 degrees, 0 degree, 30 degrees, and 60 degrees.

Figure 26:
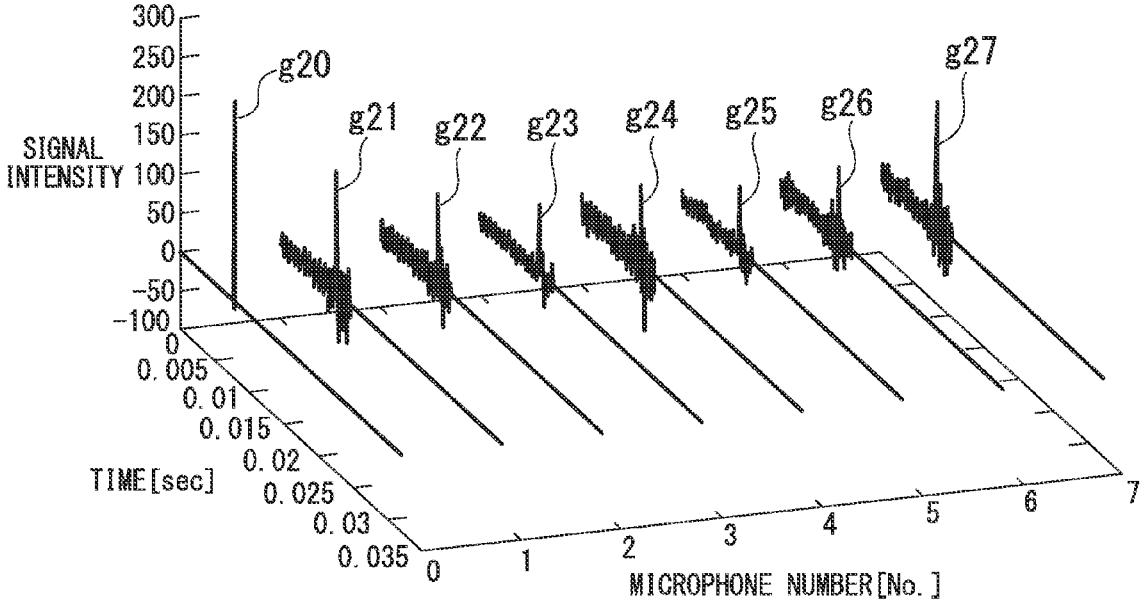
FIG. 26 is a diagram showing a result of a transfer function estimated by a transfer function estimating unit according to the third embodiment.

FIG. 26 is a diagram showing a result of a transfer function estimated by the transfer function estimating unit 103B. In FIG. 26, the horizontal axis represents a microphone number, the axis in the depth direction with respect to the paper surface represents time, and the vertical axis represents signal intensity. In FIG. 26, the sound signal collected by a microphone No. 0 is a representative channel. In FIG. 26, a waveform g20 is a transfer function of the microphone No. 0, and one of waveforms g21 to g27 is a transfer function of each of microphones No. 1 to No. 7. As the waveforms g21 to g27 in FIG. 26, all of the transfer functions of the microphones No. 0 to No. 7 have a positive time. In this way, in the test, the sound processing apparatus 10B performed sound source localization by using transfer functions shifted by a predetermined time T.

Next, a result of performing sound source localization by using the sound processing apparatus 10B is described.

Figure 27:
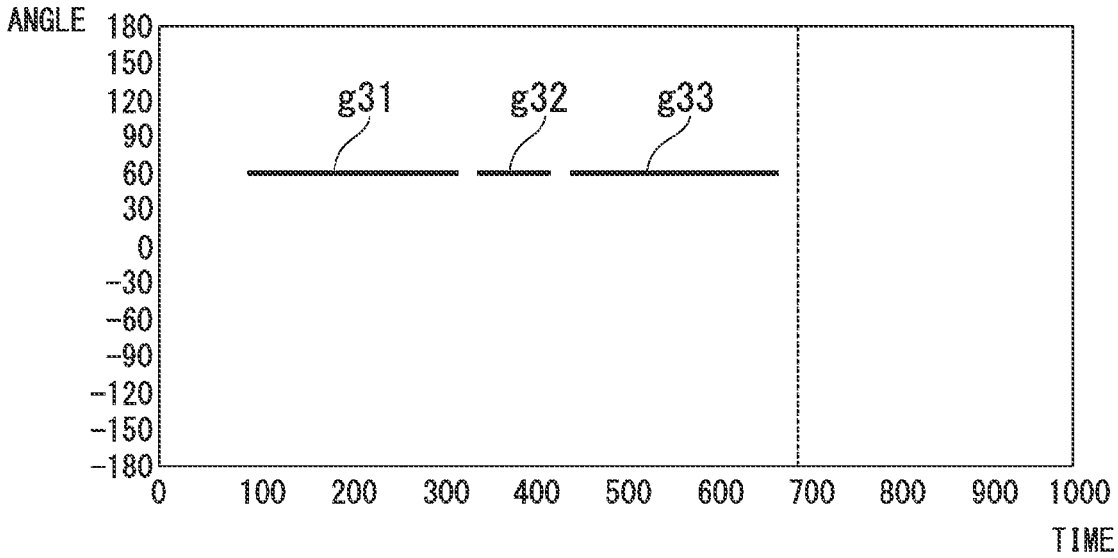
FIG. 27 is a diagram showing a result of performing sound source localization with respect to a sound source output at an angle of 60 degrees using a sound processing apparatus according to the third embodiment.
Figure 28:
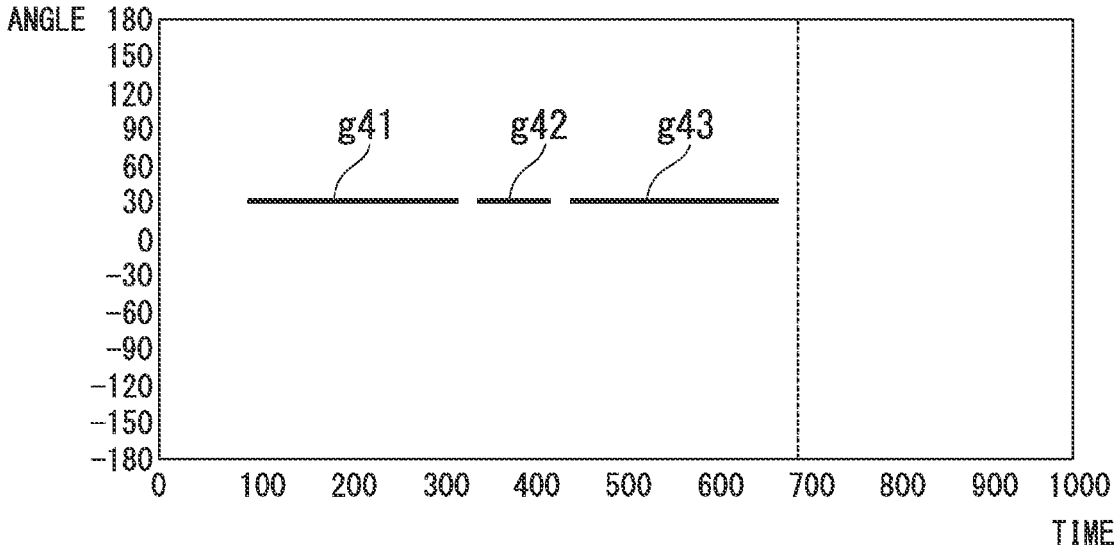
FIG. 28 is a diagram showing a result of performing sound source localization with respect to a sound source output at an angle of 30 degrees using the sound processing apparatus according to the third embodiment.
Figure 29:
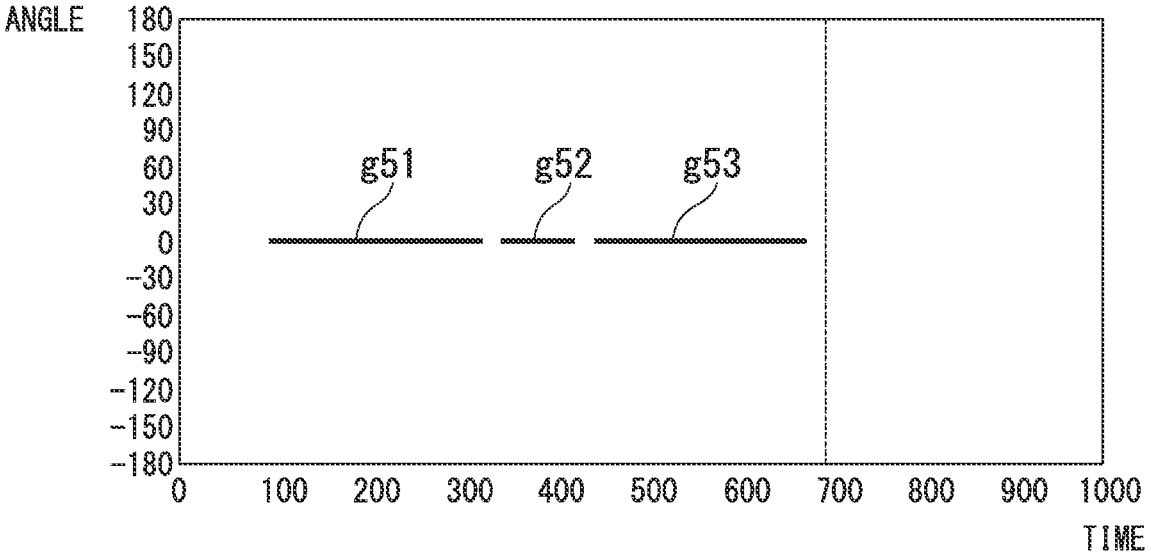
FIG. 29 is a diagram showing a result of performing sound source localization with respect to a sound source output at an angle of 0 degree using the sound processing apparatus according to the third embodiment.
Figure 30:
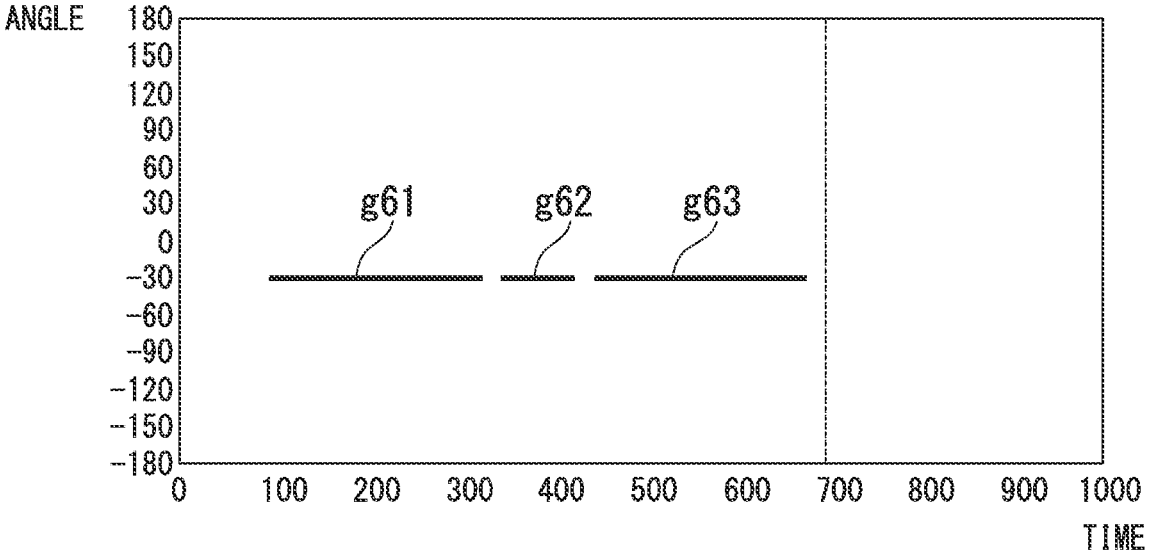
FIG. 30 is a diagram showing a result of performing sound source localization with respect to a sound source output at an angle of −30 degrees using the sound processing apparatus according to the third embodiment.
Figure 31:
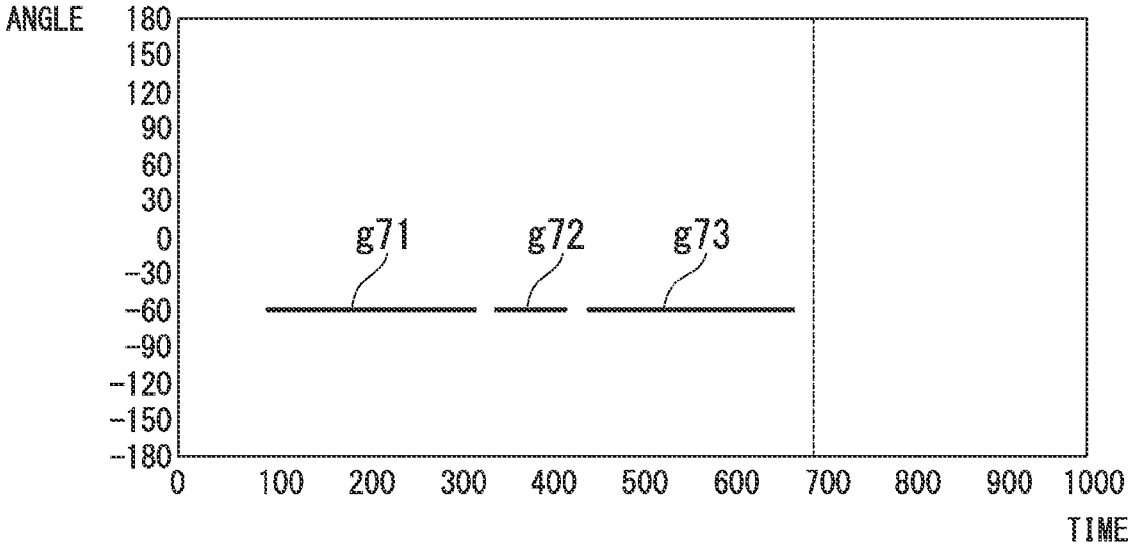
FIG. 31 is a diagram showing a result of performing sound source localization with respect to a sound source output at an angle of −60 degrees using the sound processing apparatus according to the third embodiment.

FIG. 27 is a diagram showing a result of performing sound source localization with respect to a sound source output at an angle of 60 degrees using the sound processing apparatus 10B according to the present embodiment. FIG. 28 is a diagram showing a result of performing sound source localization with respect to a sound source output at an angle of 30 degrees using the sound processing apparatus 10B according to the present embodiment. FIG. 29 is a diagram showing a result of performing sound source localization with respect to a sound source output at an angle of 0 degree using the sound processing apparatus 10B according to the present embodiment. FIG. 30 is a diagram showing a result of performing sound source localization with respect to a sound source output at an angle of −30 degrees using the sound processing apparatus 10B according to the present embodiment. FIG. 31 is a diagram showing a result of performing sound source localization with respect to a sound source output at an angle of −60 degrees using the sound processing apparatus 10B according to the present embodiment.

In FIG. 27 to FIG. 31, the horizontal axis represents time, and the vertical axis represents an estimated angle (azimuth). Each of lines g31, g41, g51, g61, and g71 represents a result of performing sound source localization of a first speech signal (for example, a first voice "Ah!"). Each of lines g32, g42, g52, g62, and g72 represents a result of performing sound source localization of a second speech signal (for example, a second voice "Ah!"). Each of lines g33, g43, g53, g63, and g73 represents a result of performing sound source localization of a third speech signal (for example, a third voice "Ah!").

As the lines g31 to g33 in FIG. 27, as a result of performing localization of the sound signal emitted at the angle of 60 degrees, a localization result of 60 degrees was obtained. As the lines g41 to g43 in FIG. 28, as a result of performing localization of the sound signal emitted at the angle of 30 degrees, a localization result of 30 degrees was obtained. As the lines g51 to g53 in FIG. 29, as a result of performing localization of the sound signal emitted at the angle of 0 degree, a localization result of 0 degree was obtained. As the lines g61 to g63 in FIG. 30, as a result of performing localization of the sound signal emitted at the angle of −30 degrees, a localization result of −30 degrees was obtained. As the lines g71 to g73 in FIG. 31, as a result of performing localization of the sound signal emitted at the angle of −60 degrees, a localization result of −60 degrees was obtained.

As described above, the sound processing apparatus 10B of the present embodiment includes: a first sound collecting unit (first sound collecting unit 30B, first sound signal acquiring unit 102B) that is placed in a sound field and collects a sound signal which is speech of a talker, by use of a plurality of microphones 301-1 to 301-M; the delaying unit 111 that delays all sound signals collected by the first sound collecting unit, by a predetermined time; the selecting unit 112 that selects one microphone of the plurality of microphones 301-1 to 301-M; the transfer function estimating unit 103B that estimates a transfer function of another microphone relative to the selected one microphone by use of a sound signal delayed by the delaying unit 111; and a sound signal processing unit (sound source localizing unit 104, sound source separating unit 105, sound feature value extracting unit 106, speech recognizing unit 107) that performs a process of the sound signal by use of the transfer function estimated by the transfer function estimating unit 103B.

According to this configuration, in the sound processing apparatus 10B of the present embodiment, an arbitrary microphone 301 of the plurality of microphones 301 included in the first sound collecting unit 30B is selected as a representative channel.

Then, by shifting the start time of the impulse in the transfer function of the representative channel by a time T, it is possible to estimate a transfer function even when there is a microphone 301 closer to the sound source than a microphone 301 corresponding to the selected representative channel. As a result, it is possible to accurately estimate a transfer function by using a microphone array without using a close-talking microphone even in a narrow space such as a vehicle inside.

The present embodiment is described using an example in FIG. 22 and FIG. 23 in which the number of microphones 301 is four; however, the embodiment is not limited thereto, and the number may be two or more. Further, the arrangement of the plurality of microphones 301 is not limited to the example of FIG. 22 in which the microphones are arranged on a plane parallel to the xy plane; however, the microphones may be three-dimensionally arranged in the xyz space.

Further, the sound processing apparatus 10B may include the mouth position estimating unit 110 (FIG. 15) described in the second embodiment. Further, as described in the second embodiment, the sound processing apparatus 10B may estimate a transfer function by performing the above update until the estimation error is minimized.

Further, the present embodiment is described using an example in which the acquired sound signal is delayed by a predetermined time T; however, the delay time T may be calculated by the sound processing apparatus 10B. For example, when the sound processing apparatus 10B is placed in a vehicle, a known sound signal is emitted from an assumed position of the mouth of the driver, and the emitted sound signal is acquired by the first sound collecting unit 30B and the first sound signal acquiring unit 102B. Then, the sound processing apparatus 10B may calculate the delay time T based on the timing of the acquired sound signal of each channel.

For example, the sound processing apparatus 10B may calculate the difference between a time when the sound signal is acquired earliest and a time when the sound signal is acquired latest and calculate, as the delay time T, a time obtained by adding a predetermined margin to the calculated difference or a time obtained by multiplying the calculated difference by a predetermined value.

In the first to third embodiments, a vehicle is described as an example of a sound field; however, the embodiment is not limited thereto. For example, the sound field may be an indoor room, a conference room, or the like. In this case, the position of a talker may be substantially fixed such as a case in which, for example, a talker sits on a sofa provided in the room or the like. When the position of a talker is substantially fixed in this way, estimation of a transfer function based on the sound signal collected by the second sound collecting unit 20 and the first sound collecting unit 30 in the sound processing apparatus 10 may be performed only once. Alternatively, estimation of a transfer function based on the sound signal collected by the first sound collecting unit 30A in the sound processing apparatus 10A may be performed only once. Alternatively, estimation of a transfer function based on the sound signal collected by the first sound collecting unit 30B in the sound processing apparatus 10B may be performed only once. After the estimation, speech recognition may be performed by using a transfer function stored in the storage unit 109, or by using a transfer function obtained by updating the stored transfer function by use of the sound signal collected by the first sound collecting unit 30 (or 30A, 30B). In this way, when the sound field is a room or the like, the second sound collecting unit 20 in the sound processing apparatus 10 may be a mobile phone or the like. In a case where the second sound collecting unit 20 in the sound processing apparatus 10 is a mobile phone or the like, a transfer function may be estimated or be updated when a talker makes a phone call.

The sound processing apparatuses 10, 10A, and 10B output the result of such speech recognition, for example, to an apparatus (for example, TV, air conditioner, projector) provided inside a room or the like.

The apparatus provided inside a room may operate corresponding to the input speech recognition result.

The sound source direction may be estimated by recording a program for performing the functions of the sound processing apparatus 10 (or 10A, 10B) according to the invention on a computer-readable recording medium, reading the program recorded on the recording medium into a computer system, and executing the program. Here, the "computer system" may include an OS or hardware such as peripherals. The "computer system" may include a WWW system including a homepage providing environment (or display environment). Examples of the "computer-readable recording medium" include portable mediums such as a flexible disk, a magneto-optical disk, a ROM, and a CD-ROM and a storage device such as a hard disk built in a computer system. The "computer-readable recording medium" may include a medium that temporarily holds a program for a predetermined time, like a volatile memory (RAM) in a computer system serving as a server or a client in a case where the program is transmitted via a network such as the Internet or a communication circuit such as a telephone circuit.

The program may be transmitted from a computer system storing the program in a storage device or the like to another computer system via a transmission medium or by transmission waves in the transmission medium. Here, the "transmission medium" via which the program is transmitted means a medium having a function of transmitting information such as a network (communication network) such as the Internet or a communication circuit (communication line) such as a telephone line. The program may be configured to realize a part of the above-mentioned functions or may be configured to realize the above-mentioned functions by combination with a program recorded in advance in a computer system, like a so-called differential file (differential program).

While preferred embodiments of the invention have been described and shown above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

The invention claimed is:

1. A sound processing apparatus comprising:

a first sound collecting unit placed in a sound field and configured to collect a sound signal which is speech of a talker;

a second sound collecting unit arranged to be movable to a position which is closer to the talker than the first sound collecting unit and configured to collect the sound signal;

a transfer function estimating unit configured to estimate a transfer function in the sound field from a sound signal collected by the first sound collecting unit and a sound signal collected by the second sound collecting unit when the talker is at a predetermined position in the sound field; and a sound signal processing unit configured to perform a process of the sound signal by use of the transfer function estimated by the transfer function estimating unit, wherein the first sound collecting unit is arranged at a position where a direct or reflected sound of the talker can be collected, and the second sound collecting unit is arranged at a position where a direct sound of the talker can be collected.

2. The sound processing apparatus according to claim 1, further comprising:

a storage unit configured to store the transfer function estimated by the transfer function estimating unit; and a talker identifying unit configured to identify the talker, wherein the transfer function estimating unit selects, when the transfer function of the talker identified by the talker identifying unit is stored in the storage unit, the transfer function which corresponds to the talker and is stored in the storage unit.

3. The sound processing apparatus according to claim 2, wherein the transfer function estimating unit performs notification which prompts the talker to utter when the transfer function of the talker identified by the talker identifying unit is not stored in the storage unit.

4. The sound processing apparatus according to claim 1, wherein the first sound collecting unit collects a sound signal when the talker utters, and the transfer function estimating unit sequentially updates the transfer function based on the sound signal collected by the first sound collecting unit.

5. The sound processing apparatus according to claim 1, further comprising:

a storage unit configured to preliminarily store a predetermined transfer function, wherein the transfer function estimating unit interpolates the transfer function stored preliminarily in the storage unit by use of the transfer function estimated based on the sound signal collected by the first sound collecting unit and the sound signal collected by the second sound collecting unit.

6. A sound processing apparatus comprising:

a first sound collecting unit placed in a sound field and configured to collect a sound signal which is speech of a talker;

a talker position estimating unit configured to estimate a talker position which is a position of the talker relative to the first sound collecting unit;

a transfer function estimating unit configured to estimate a transfer function in the sound field from the estimated talker position and a sound signal collected by the first sound collecting unit when the talker is at a predetermined position in the sound field; and a sound signal processing unit configured to perform a process of the sound signal by use of the transfer function estimated by the transfer function estimating unit, wherein the first sound collecting unit is arranged at a position where a direct or reflected sound of the talker can be collected.

7. A sound processing apparatus comprising:

a first sound collecting unit placed in a sound field and configured to collect a sound signal which is speech of a talker, by use of a plurality of microphones;

a delaying unit configured to delay all sound signals collected by the first sound collecting unit when the talker is at a predetermined position in the sound field, by a predetermined time;

a selecting unit configured to select one microphone of the plurality of microphones;

a transfer function estimating unit configured to estimate a transfer function of another microphone relative to the selected one microphone in the sound field by use of a sound signal delayed by the delaying unit; and a sound signal processing unit configured to perform a process of the sound signal by use of the transfer function estimated by the transfer function estimating unit, wherein the first sound collecting unit is arranged at a position where a direct or reflected sound of the talker can be collected.

8. A sound processing method comprising:

(a) by way of a first sound collecting unit placed in a sound field, collecting a sound signal which is speech of a talker;

(b) by way of a second sound collecting unit arranged to be movable to a position which is closer to the talker than the first sound collecting unit, collecting the sound signal;

(c) by way of a transfer function estimating unit, estimating a transfer function in the sound field from a sound signal collected in the step (a) and a sound signal collected in the step (b) when the talker is at a predetermined position in the sound field; and (d) by way of a sound signal processing unit, performing a process of the sound signal by use of the transfer function estimated in the step (c), wherein the first sound collecting unit is arranged at a position where a direct or reflected sound of the talker can be collected, and the second sound collecting unit is arranged at a position where a direct sound of the talker can be collected.

9. A sound processing method comprising:

(a) by way of a first sound collecting unit placed in a sound field, collecting a sound signal which is speech of a talker, by use of a plurality of microphones;

(b) by way of a delaying unit, delaying all sound signals collected in the step (a) when the talker is at a predetermined position in the sound field, by a predetermined time;

(c) by way of a selecting unit, selecting one microphone of the plurality of microphones;

(d) by way of a transfer function estimating unit, estimating a transfer function of another microphone relative to the one microphone selected in the step (c) in the sound field by use of a sound signal delayed in the step (b); and (e) by way of a sound signal processing unit, performing a process of the sound signal by use of the transfer function estimated in the step (d), wherein the first sound collecting unit is arranged at a position where a direct or reflected sound of the talker can be collected.

10. A non-transitory computer-readable recording medium comprising a sound processing program causing a computer of a sound processing apparatus including a first sound collecting unit placed in a sound field and a second sound collecting unit arranged to be movable to a position which is closer to a talker than the first sound collecting unit to perform:

(a) by way of the first sound collecting unit, collecting a sound signal which is speech of the talker;

(b) by way of the second sound collecting unit, collecting the sound signal;

(c) estimating a transfer function in the sound field from a sound signal collected in the step (a) and a sound signal collected in the step (b) when the talker is at a predetermined position in the sound field; and (d) performing a process of the sound signal by use of the transfer function estimated in the step (c), wherein the first sound collecting unit is arranged at a position where a direct or reflected sound of the talker can be collected, and the second sound collecting unit is arranged at a position where a direct sound of the talker can be collected.

11. A non-transitory computer-readable recording medium comprising a sound processing program causing a computer of a sound processing apparatus including a first sound collecting unit placed in a sound field to perform:

(a) by way of the first sound collecting unit, collecting a sound signal which is speech of a talker, by use of a plurality of microphones;

(b) delaying all sound signals collected in the step (a) when the talker is at a predetermined position in the sound field, by a predetermined time;

(c) selecting one microphone of the plurality of microphones;

(d) estimating a transfer function of another microphone relative to the one microphone selected in the step (c) in the sound field by use of a sound signal delayed in the step (b); and (e) performing a process of the sound signal by use of the transfer function estimated in the step (d), wherein the first sound collecting unit is arranged at a position where a direct or reflected sound of the talker can be collected.

* * * * *